US010426222B2

(12) United States Patent
Barnes et al.

(10) Patent No.: US 10,426,222 B2
(45) Date of Patent: Oct. 1, 2019

(54) SOLE STRUCTURE FOR AN ARTICLE OF FOOTWEAR

(71) Applicant: NIKE, Inc., Beaverton, OR (US)

(72) Inventors: Elizabeth Barnes, Beaverton, OR (US); Jeremy L. Connell, Beaverton, OR (US); Zachary Elder, Beaverton, OR (US); Fred Fagergren, Beaverton, OR (US); Gary M. Peters, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 239 days.

(21) Appl. No.: 15/284,969

(22) Filed: Oct. 4, 2016

(65) Prior Publication Data

US 2017/0020227 A1 Jan. 26, 2017

Related U.S. Application Data

(62) Division of application No. 13/963,093, filed on Aug. 9, 2013, now Pat. No. 9,480,303.

(51) Int. Cl.

| | |
|---|---|
| ***A43B 13/18*** | (2006.01) |
| ***A43B 13/14*** | (2006.01) |
| ***A43B 13/04*** | (2006.01) |
| ***A43B 13/12*** | (2006.01) |
| ***A43B 13/22*** | (2006.01) |

(52) U.S. Cl.

CPC ..... *A43B 13/141* (2013.01); *A43B 13/04* (2013.01); *A43B 13/122* (2013.01); *A43B 13/125* (2013.01); *A43B 13/183* (2013.01); *A43B 13/186* (2013.01); *A43B 13/188* (2013.01); *A43B 13/22* (2013.01)

(58) Field of Classification Search

CPC ..... A43B 13/02; A43B 13/04; A43B 13/12; A43B 13/14; A43B 13/184; A43B 13/206; A43B 5/02; B29D 35/142

USPC ..... 36/28

See application file for complete search history.

(56) References Cited

U.S. PATENT DOCUMENTS

| | | | | |
|---|---|---|---|---|
| 1,920,112 | A | 7/1933 | Shaft | |
| 2,424,609 | A | 7/1947 | Friedmann | |
| 2,447,603 | A | 8/1948 | Snyder | |
| 2,508,318 | A | 5/1950 | Wallach | |
| 2,767,487 | A | 10/1956 | Friedmann | |
| D252,836 | S | 9/1979 | Picker | |
| 4,492,046 | A | 1/1985 | Kosova | |
| 4,534,124 | A | 8/1985 | Schnell | |
| 4,566,206 | A * | 1/1986 | Weber | A43B 21/26 36/27 |
| 4,592,153 | A * | 6/1986 | Jacinto | A43B 21/30 36/27 |

(Continued)

*Primary Examiner* — Anne M Kozak
(74) *Attorney, Agent, or Firm* — Banner & Witcoff, Ltd.

(57) ABSTRACT

A sole structure for an article of footwear includes an upper element, a lower element positioned below the upper element and a flexure element. The flexure element may be joined to one of the upper element and the lower element. The flexure element may be configured for slidingly contacting the other of the upper element and the lower element when a vertical compressive load is applied to the upper element. A second flexure element may be provided that extends from the upper element toward the lower element (or vice versa). An article of footwear having the sole structure attached to an upper is also provided.

20 Claims, 12 Drawing Sheets

(56) References Cited

U.S. PATENT DOCUMENTS 5,138,776 A 8/1992 Levin
5,195,258 A 3/1993 Loader
5,435,079 A 7/1995 Gallegos
5,701,686 A 12/1997 Herr et al.
5,826,350 A 10/1998 Wallerstein
5,875,567 A 3/1999 Bayley
6,282,814 B1 9/2001 Krafsur et al.
6,341,432 B1 * 1/2002 Muller ..... A43B 13/10 36/102
6,449,878 B1 * 9/2002 Lyden ..... A43B 1/0081 36/27
6,557,271 B1 * 5/2003 Weaver, III ..... A43B 3/0063 36/144
6,860,034 B2 3/2005 Schmid
6,865,824 B2 * 3/2005 Levert ..... A43B 13/182 36/27
6,886,274 B2 5/2005 Krafsur et al.
D507,094 S * 7/2005 Lyden ..... D2/946
6,925,732 B1 * 8/2005 Clarke ..... A43B 7/141 36/27
6,928,756 B1 8/2005 Haynes
6,948,262 B2 * 9/2005 Kerrigan ..... A43B 3/0063 36/27
6,964,119 B2 * 11/2005 Weaver, III ..... A43B 3/0063 36/27
7,100,308 B2 9/2006 Aveni
7,219,447 B2 5/2007 LeVert et al.
7,334,351 B2 2/2008 Hann
7,350,320 B2 4/2008 Chandler et al.
7,644,518 B2 1/2010 Chandler et al.
7,788,824 B2 9/2010 Hann
8,220,185 B2 * 7/2012 Baker ..... A43B 3/0042 36/103
8,500,825 B2 * 8/2013 Christensen ..... A61F 2/66 623/55
2001/0049888 A1 12/2001 Krafsur et al.
2002/0174567 A1 11/2002 Krafsur et al.
2003/0163933 A1 9/2003 Krafsur et al.
2005/0102857 A1 * 5/2005 Yen ..... A43B 3/0052 36/28
2005/0102858 A1 * 5/2005 Yen ..... A43B 3/0052 36/28
2005/0102859 A1 5/2005 Yen
2005/0126039 A1 6/2005 LeVert et al.
2005/0268488 A1 12/2005 Hann
2006/0010715 A1 1/2006 Tseng et al.
2006/0130362 A1 6/2006 Juan
2007/0101617 A1 5/2007 Brewer et al.
2007/0175066 A1 8/2007 Hann
2008/0256827 A1 * 10/2008 Hardy ..... A43B 13/181 36/27
2009/0145004 A1 6/2009 Jones
2011/0023328 A1 2/2011 Testa et al.
2013/0118028 A1 * 5/2013 Yoon ..... A43B 13/143 36/27
2014/0310982 A1 * 10/2014 Delattre ..... A43B 3/0052 36/28
2015/0026996 A1 * 1/2015 Baum ..... A43B 13/183 36/27
2015/0040435 A1 * 2/2015 Barnes ..... A43B 13/183 36/102
2015/0047229 A1 * 2/2015 Elliott ..... A43B 13/04 36/102

* cited by examiner

SOLE STRUCTURE FOR AN ARTICLE OF FOOTWEAR

CROSS REFERENCE TO RELATED APPLICATIONS

This application is a divisional application of application Ser. No. 13/963,093, filed Aug. 9, 2013, which is incorporated herein by reference.

FIELD

Aspects of the present invention relate to sole structures for articles of footwear and articles of footwear including such sole structures. More particularly, various examples relate to sole structures having improved vertical compression and transverse stiffness characteristics.

BACKGROUND

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to fully utilize the natural motion of the foot.

Despite the differences between various footwear styles, sole structures for conventional footwear generally include multiple layers that are referred to as an insole, a midsole, and an outsole. The insole is a thin, comfort-enhancing member located adjacent to the foot. The outsole forms the ground-contacting element of footwear and is usually fashioned from a durable, wear resistant material that may include texturing or other features to improve traction.

The midsole forms the middle layer of the sole and serves a variety of purposes that include controlling potentially harmful foot motions, such as over pronation; shielding the foot from excessive ground reaction forces; and beneficially utilizing such ground reaction forces for more efficient toe-off. Conventional midsoles may include a foam material to attenuate impact forces and absorb energy when the footwear contacts the ground during athletic activities. Other midsoles may utilize fluid-filled bladders (e.g., filled with air or other gasses) to attenuate impact forces and absorb energy.

Although foam materials in the midsole succeed in attenuating impact forces for the foot, foam materials that are relatively soft may also impart instability that increases in proportion to midsole thickness. For example, the use of very soft materials in the midsole of running shoes, while providing protection against vertical impact forces, can encourage instability of the ankle, thereby contributing to the tendency for over-pronation. This instability has been cited as a contributor to "runner's knee" and other athletic injuries. For this reason, footwear design often involves a balance or tradeoff between impact force attenuation and stability.

Stabilization is also a factor in sports like basketball, volleyball, football, and soccer. In addition to running, an athlete may be required to perform a variety of motions including transverse movement, quickly executed direction changes, stops, and starts; movement in a backward direction; and jumping (vertically or with both a vertical and horizontal component). While making such movements, footwear instability may lead to excessive inversion or eversion of the ankle joint, potentially causing an ankle sprain.

High-action sports, such as soccer, basketball, football, rugby, ultimate, etc., impose special demands upon players and their footwear. Accordingly, it would be desirable to provide footwear that achieves better dynamic control of the wearer's movements, while at the same time providing impact-attenuating features that protect the wearer from excessive impact loads.

BRIEF SUMMARY

According to aspects of the invention, a sole structure for an article of footwear includes an upper element and a lower element position below the upper element. The upper element has a lower surface and the lower element has an upper surface opposed to the lower surface. An elongated flexure element may be joined to a base element, wherein the base element constitutes at least part of one of the upper element or the lower element. Thus a flexure element may extend downward from the lower surface of the upper element and/or a flexure element may extend upwards from the upper surface of the lower element. Further, the flexure element may be configured for slidingly contacting the other of the upper lower surface and the upper surface when a vertical compressive load is applied to the upper element. The flexure element may extend from the base element generally toward a midfoot region of the sole structure. Alternatively, the flexure element may generally extend from the base element away from the midfoot region. When the flexure element is located in a heel region of the sole structure, one or more flexure elements may extend toward the midfoot region and/or toward a back edge of the article of footwear.

According to certain aspects, a sole structure includes an upper element, a lower element positioned below the upper element, and a flexure element. The flexure element may be joined to a base element, the base element being at least a part of one of the upper element and the lower element. The flexure element may be configured for slidingly contacting an opposed element when a vertical compressive load is applied to the upper element, the opposed element being the other of the upper element and the lower element (i.e., the element not including the base element identified above).

According to other aspects of the invention, a sole structure includes an upper element, a lower element positioned below the upper element, and a plurality of flexure elements. A first elongated, cantilevered flexure element may be joined to a base element, the base element being at least part of one of the upper element and the lower element. The first flexure element may extend from the base element toward an opposed element, the opposed element being the other of the upper element and the lower element. A second elongated, cantilevered flexure element may be joined to the opposed element, and may extend from the opposed element toward the base element. The first and second cantilever flexure elements may have free ends.

According to some aspects, one or more of the flexure elements may be a plate-like element. Further, the flexure element may have a concavely-curved portion facing the base element and/or a convexly-curved portion facing the opposed element. The convexly-curved portion of the flexure element may be configured to slidingly contact the opposed element when a vertical compressive load is applied to the upper element. The opposed end of the flexure element may be configured to contact the base element when a vertical compressive load is applied to the upper element.

According to even other aspects, the upper element and the lower element may be attached to each other at a common end. The upper element, lower element, common end and flexure elements may be unitarily formed, or they may constitute multiple parts.

According to certain aspects, a first flexure element may be laterally offset from a second flexure element. The first and second flexure elements may contact one another when a lateral load is applied to the upper element. The flexure elements may extend in opposed directions.

According to another aspect of the invention, an article of footwear including an upper attached to the sole structure disclosed herein is also provided. The upper and lower elements may be located, at least partially, in the heel region of the article of footwear or, at least partially, in the forefoot region on the article of footwear.

BRIEF DESCRIPTION OF THE DRAWINGS

The foregoing Summary, as well as the following Detailed Description, will be better understood when read in conjunction with the accompanying drawings.

Figure 1A:
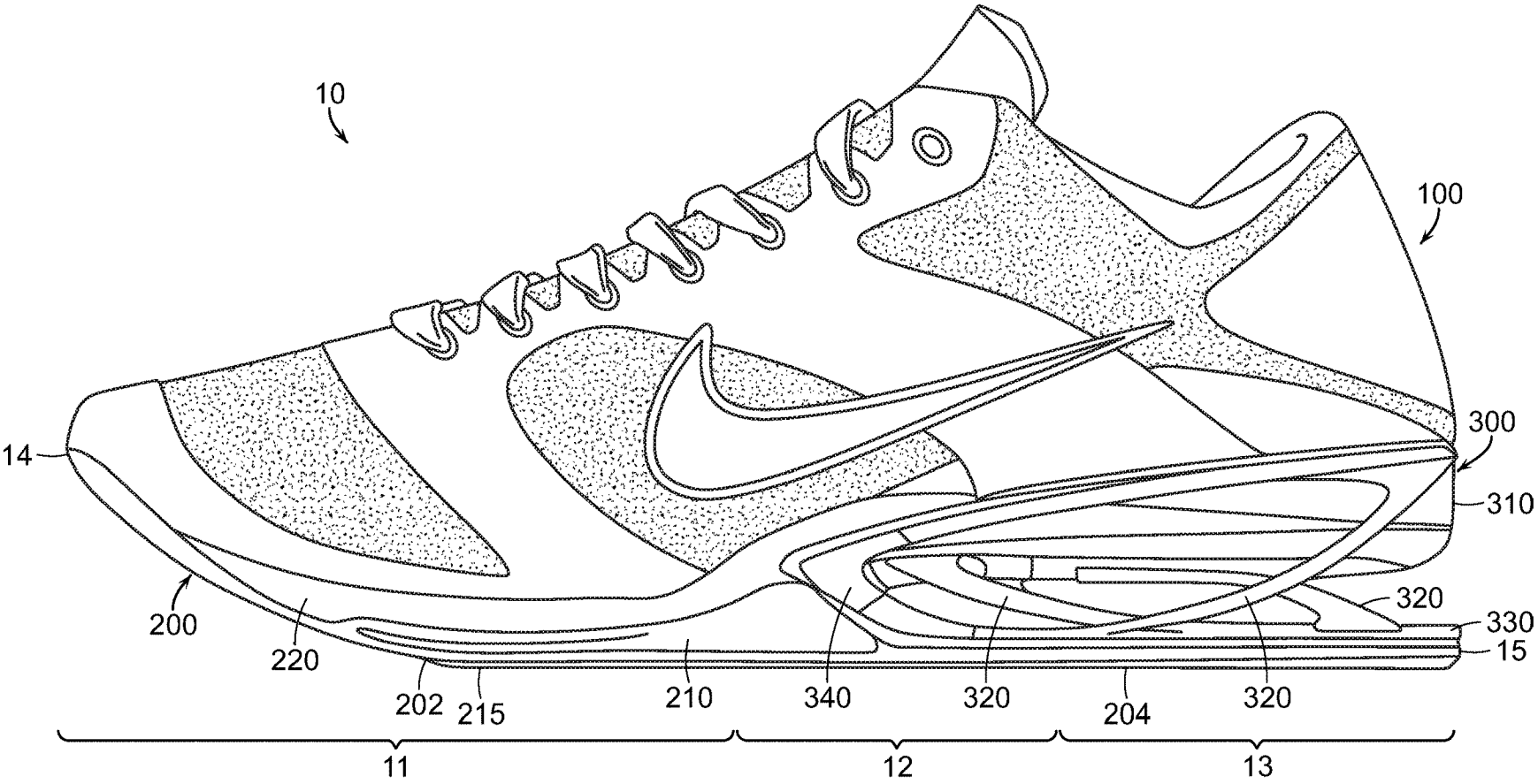
FIG. 1A is a side view, looking from the lateral side, of an article of footwear having an upper and a sole structure in accordance with aspects of this disclosure.

It should be understood that the appended drawings are not necessarily to scale, presenting a somewhat simplified representation of various features illustrative of specific aspects of the invention. Certain features of the illustrated embodiments may have been enlarged or distorted relative to others to facilitate visualization and clear understanding. In particular, thin features may be thickened, for example, for clarity of illustration.

DETAILED DESCRIPTION

The following discussion and accompanying figures disclose articles of footwear having sole structures with sole geometries in accordance with various embodiments of the present disclosure. Concepts related to the sole geometry are disclosed with reference to a sole structure for an article of athletic footwear. The disclosed sole structure may be incorporated into a wide range of athletic footwear styles, including shoes that are suitable for rock climbing, bouldering, hiking, running, baseball, basketball, cross-training, football, rugby, tennis, volleyball, and walking, for example. In addition, sole structures according to various embodiments as disclosed herein may be incorporated into footwear that is generally considered to be non-athletic, including a variety of dress shoes, casual shoes, sandals, slippers, and boots. An individual skilled in the relevant art will appreciate, given the benefit of this specification, that the concepts disclosed herein with regard to the sole structure apply to a wide variety of footwear styles, in addition to the specific styles discussed in the following material and depicted in the accompanying figures.

Sports generally involve consistent pounding of the foot and/or periodic high vertical impact loads on the foot. Thus, a sole structure for an article of footwear having an impact-attenuation system capable of handling high impact loads may be desired. Additionally, however, many sports involve transverse movements that are separate from the movements that involve large vertical impact loads. It may be desirable to have a relatively soft transverse stiffness characteristic (for example, to cushion in cutting), while at the same time having a robust vertical impact-attenuation characteristic. Optionally, it may be desirable to have a relatively unforgiving transverse stiffness characteristic (for example, to provide greater stability), while at the same time having a relatively compliant vertical impact-attenuation characteristic. Thus, it may be advantageous to have a sole structure that decouples the vertical stiffness characteristic from the transverse stiffness characteristic. Such a decoupled sole structure would provide a vertical stiffness response that is independent of (or relatively independent of) the transverse stiffness response. While it may be advantageous to have such a decoupled sole structure located in the forefoot region of the footwear, it may be particularly advantageous to have such a decoupled sole structure located in the heel region of the footwear.

As noted above, according to certain aspects, it may be advantageous to have a sole structure that decouples the vertical stiffness characteristic from a side-to-side transverse stiffness characteristic. For certain specific applications, it may even be advantageous to have a sole structure that decouples the vertical stiffness characteristic from a front-to-back transverse stiffness characteristic.

Various aspects of this disclosure relate to articles of footwear having a sole structure with a support structure assembly designed to decouple its vertical stiffness characteristics from its transverse stiffness characteristics. Thus, according to certain embodiments, it would be desirable to tailor footwear to provide an optimum amount of protection against vertical impact loads, yet at the same time provide an optimum level of transverse flexibility/stability.

As used herein, the terms "upper," "lower," "top," "bottom," "upward," "downward," "vertical," "horizontal," "longitudinal," "transverse," "front," "back," "forward," "rearward," etc., unless otherwise defined or made clear from the disclosure, are relative terms meant to place the various structures or orientations of the structures of the article of footwear in the context of an article of footwear worn by a user standing on a flat, horizontal surface. "Transverse" refers to a generally sideways (i.e., medial-to-lateral or heel-to-toe) orientation (as opposed to a generally vertical orientation). "Lateral" refers to a generally medial-to-lateral (i.e., side-to-side) transverse orientation. "Longitudinal" refers to a generally heel-to-toe (i.e., front-to-back) transverse orientation. A "lateral roll" is characterized by upward and/or downward displacement of a medial side of a foot portion relative to a lateral side of the foot portion. A "longitudinal roll" is characterized by upward and/or downward displacement of a forward side of a foot portion relative to a rearward side of the foot portion.

Figure 1B:
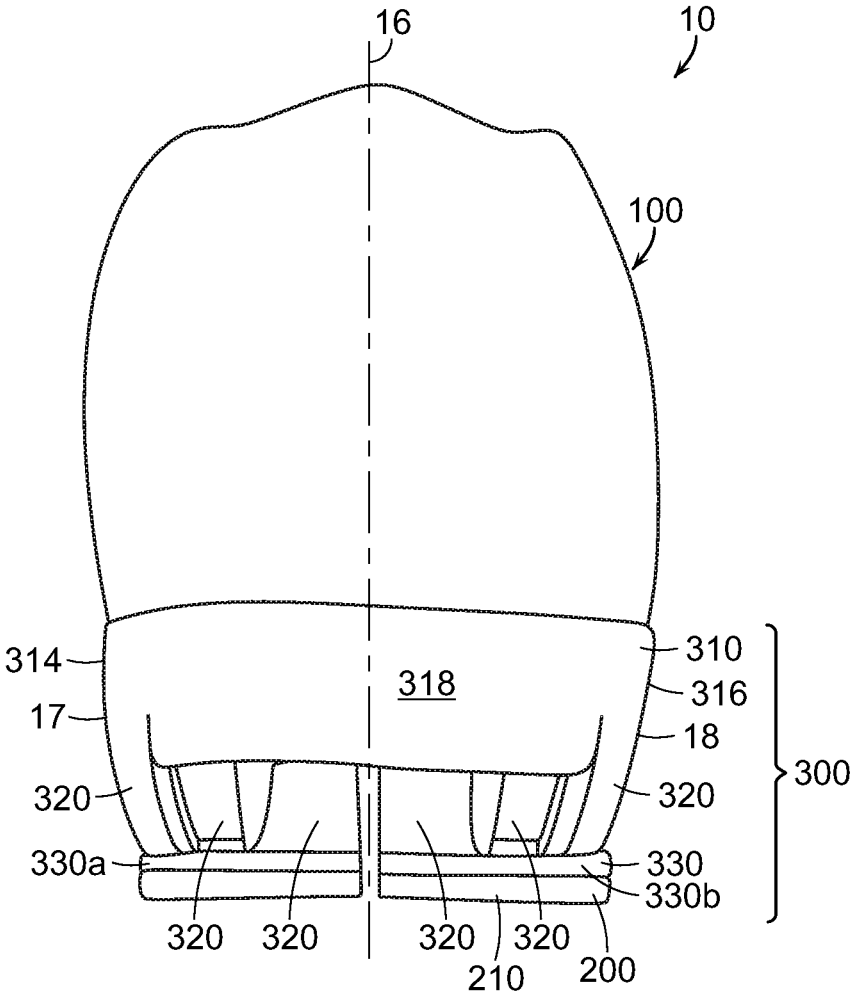
FIG. 1B is a rear view of the article of footwear of FIG. 1A.

Referring to FIGS. 1A-1B, an article of footwear 10 generally includes two primary components: an upper 100 and a sole structure 200. Upper 100 is secured to sole structure 200 and forms a void on the interior of footwear 10 for comfortably and securely receiving a foot. Sole structure 200 is secured to a lower portion of upper 100 and is positioned between the foot and the ground. Upper 100 may include an opening that provides the foot with access to the void within upper 100. As is conventional, upper 100 may also include a vamp area having a throat and a closure mechanism, such as laces.

Typically, the article of footwear 10 has a forefoot region 11, a midfoot region 12 and a heel region 13. Although regions 11-13 apply generally to footwear 10, references to regions 11-13 may also apply to upper 100, sole structure 200, or an individual component within either upper 100 or sole structure 200.

Sole structure 200 of the article of footwear 10 further has a toe or front edge 14 and a heel or back edge 15. A lateral edge 17 and a medial edge 18 each extend from the front edge 14 to the back edge 15. Further, sole structure 200 of the article of footwear 10 defines a longitudinal centerline 16 extending from the back edge 15 to the front edge 14 and located generally midway between the lateral edge 17 and the medial edge 18. The centerline 16 generally bisects footwear 10, thereby defining a lateral side and a medial side.

According to certain aspects and referring to FIGS. 1A-1B, sole structure 200 includes a forward portion 202 and a rearward portion 204. Forward portion 202 may encompass forefoot region 11 and some or all of midfoot region 12. Rearward portion 204 may encompass heel region 13 and some or all of midfoot region 12. Thus, some portion of forward portion 202 and/or rearward portion 204 of sole structure 200 may be located in the midfoot region 12. In this particular configuration, forward portion 202 includes any desired type of conventional midsole structure 220 and any desired type of conventional outsole structure 210. Rearward portion 204 includes a support assembly structure 300 in accordance with at least some examples of this invention.

Referring to FIG. 1A, sole structure 200 may include multiple layers and/or multiple components. For example, forward portion 202 includes an outsole structure 210 and a midsole structure 220, and may include an insole (not shown). Outsole structure 210 forms the ground-engaging portion (or other contact surface-engaging portion) of sole structure 200, thereby providing traction and a feel for the engaged surface. Outsole structure 210 may also assist in providing stability and localized support for the foot. Even further, outsole structure 210 (and in some instances, insole) may assist in providing impact force attenuation capabilities.

Outsole structure 210 may be formed of conventional outsole materials, such as natural or synthetic rubber or a combination thereof. The material may be solid, foamed, filled, etc. or a combination thereof. One particular rubber for use in outsole structure 210 may be an OGRS rubber (such as OGRS001 rubber). Another particular composite rubber mixture may include approximately 75% natural rubber and 25% synthetic rubber such as a styrene-butadiene rubber. Other suitable polymeric materials for the outsole structure include plastics, such as PEBAX® (a poly-ether-block co-polyamide polymer available from Atofina Corporation of Puteaux, France), silicone, thermoplastic polyurethane (TPU), polypropylene, polyethylene, ethylvinylacetate, and styrene ethylbutylene styrene, etc. Optionally, outsole structure 210 may also include fillers or other components to tailor its hardness, wear, durability, abrasion-resistance, compressibility, stiffness and/or strength properties. Thus, for example, outsole structure 210 may include reinforcing fibers, such as carbon fibers, glass fibers, graphite fibers, aramid fibers, basalt fibers, etc.

Further, outsole structure 210 may include a ground-contacting layer 215 that is formed separately from the other portions of outsole structure 210 and subsequently integrated therewith. The ground-contacting layer 215 may be formed of an abrasion resistant material that may be co-molded, laminated, adhesively attached or applied as a coating to form a lower surface of outsole 210.

Referring back to FIG. 1A, forward portion 202 of this example sole structure 200 also includes a midsole structure 220. Midsole structure 220 is positioned between outsole structure 210 and upper 100. Midsole structure 220 may be secured to upper 100 along the lower length of the upper 100 in any conventionally known manner.

Typically, a conventional midsole structure may have a resilient, polymer foam material, such as polyurethane or ethylvinylacetate. One example foam is an IP003 foam. The foam may extend throughout the length and width of the forward portion 202. In general, a relatively thick foam layer will provide greater impact force attenuation than a relatively thin foam layer, but it may also have less stability than the relatively thin foam layer. Optionally, a conventional midsole structure may incorporate sealed chambers, fluid-filled bladders, channels, ribs, columns (with or without voids), etc.

The optional insole (or sockliner), is generally a thin, compressible member located within the void for receiving the foot and proximate to a lower surface of the foot. Typically, the insole, which is configured to enhance footwear comfort, may be formed of foam, and optionally a foam component covered by a moisture wicking fabric or textile material. Further, the insole or sockliner may be glued or otherwise attached to the other components of sole structure 200, although it need not be attached, if desired.

According to certain aspects and referring to FIGS. 1A-1B and FIGS. 2A-2D, rearward portion 204 of sole structure 200 may include support assembly structure 300.

According to certain aspects, support assembly structure 300 decouples, or at least partially decouples, a vertical compressive stiffness characteristic from a lateral stiffness characteristic.

According to the embodiments illustrated in FIGS. 1A-1B and FIGS. 2A-2D, support assembly structure 300 includes an upper element 310, a lower element 330, and at least one flexure element 320. The upper and lower elements 310, 330 extend substantially horizontally, with lower element 330 located below and spaced apart from upper element 310. Upper element 310 has a lower surface and lower element 330 has an upper surface. The upper surface of lower element 330 is opposed to (i.e., it faces) the lower surface of upper element 310.

Typically, support assembly structure 300 may include a plurality of flexure elements 320*a*, 320*b*, 320*c*, etc. Further, the plurality of flexure elements 320 may be arranged as pairs on either side of the centerline 16. One or more of the flexure elements 320 may extend upward from the lower element 330. One or more of the flexure elements 320 may extend downward from the upper element 310. Further, one or more of the flexure elements 320 may extend upward and longitudinally forward from lower element 330. Optionally, one or more of the flexure elements 320 may extend upward and longitudinally rearward from lower element 330. One or more of the flexure elements 320 may extend downward and longitudinally rearward from upper element 310. Optionally, one or more of the flexure elements 320 may extend downward and longitudinally forward from upper element 310. In general, as explained in more detail below, the flexure elements 320 may also extend at an angle, i.e., a non-zero angle, to the longitudinal centerline 16.

As shown in the particular embodiment of FIGS. 2A-2D, flexure elements 320*a* and 320*b* may extend upward and forward from lower element 330; flexure elements 320*c* and 320*d* may extend downward and rearward from upper element 310; and flexure elements 320*e* and 320*f* may extend downward and forward from upper element 310. Although in this particular embodiment, referring to FIG. 2D, the forward and rearward extensions of the flexure elements 320 may generally be aligned with the centerline 16, in other embodiments the flexure elements 320 may extend at an angle ($\alpha$) to the centerline 16. Thus, by way of examples and referring to FIG. 3, one or more flexure elements 320 may extend at an angle ($\alpha$) of approximately 0 degrees, from approximately 0 to approximately 5 degrees, up to approximately 10 degrees, up to approximately 20 degrees, up to approximately 45 degrees, up to approximately 70 degrees, or even up to approximately 90 degrees (i.e., perpendicular) to the centerline 16. Further, although in the particular embodiments of FIGS. 1A-1B and FIGS. 2A-2D, the flexure elements 320 may generally be aligned with each other, in other embodiments (referring to FIG. 3), the extension direction of the individual flexure elements 320 may be skewed at an angle relative to one another.

In the embodiments of FIGS. 1A-1B and FIGS. 2A-2D, flexure elements 320*a* and 320*b* may be identical to each other and may be positioned relatively close to one another, one either side of the centerline 16. Flexure elements 320*c* and 320*d* may also be identical to each other and may be positioned to the outside of flexure elements 320*a* and 320*b*, i.e., flexure elements 320*c* and 320*d* may be positioned farther from the centerline 16 than flexure elements 320*a* and 320*b*. Flexure elements 320*e* and 320*f* may also be identical to each other and may be positioned to the outside of flexure elements 320*c* and 320*d*, i.e., flexure elements 320*e* and 320*f* may be positioned farther from the centerline 16 than flexure elements 320*c* and 320*d*.

In general, the flexure elements 320 need not be identical nor arranged in pairs symmetrically positioned on either side of the centerline 16. Thus, in the particular embodiment of FIG. 2D, flexure elements 320*c* and 320*d* may be longer than flexure elements 320*a* and 320*b*. Additionally, for this particular embodiment, flexure elements 320*e* and 320*f* may not be as wide as flexure elements 320*a*-320*d*. The lesser width of flexure elements 320*e*, 320*f* may result in these flexure elements being less stiff than the other, wider flexure elements. Optionally, however, other parameters (thickness, length, cross-section area, curvature, opposed end constraints, material(s), etc.) of the flexure elements 320*e*, 320*f* may be tailored such that the stiffness could be the same or even greater than flexure elements 320*a*-320*d*, even though flexure elements 320*e*, 320*f* may present a more slender profile.

Figure 4:
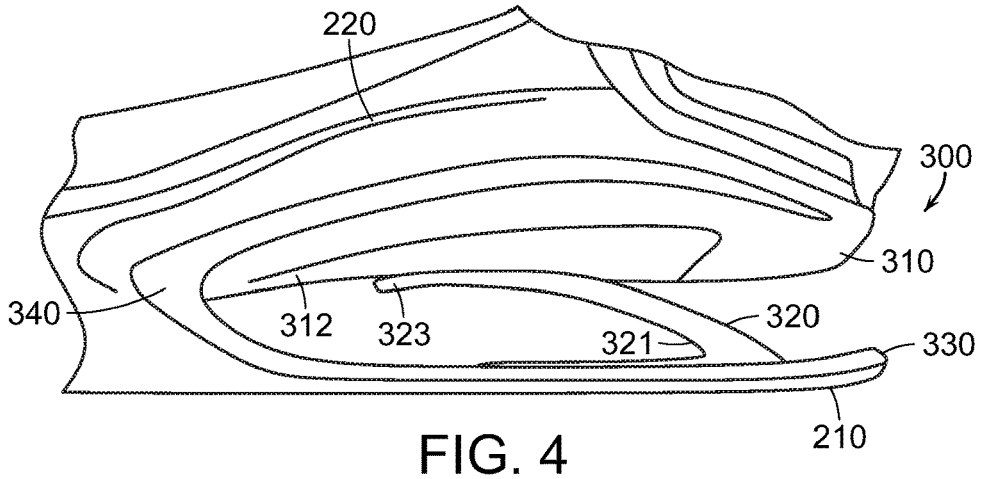
FIG. 4 is a lateral side view of a sole structure in accordance with aspects of this disclosure.
Figure 5:
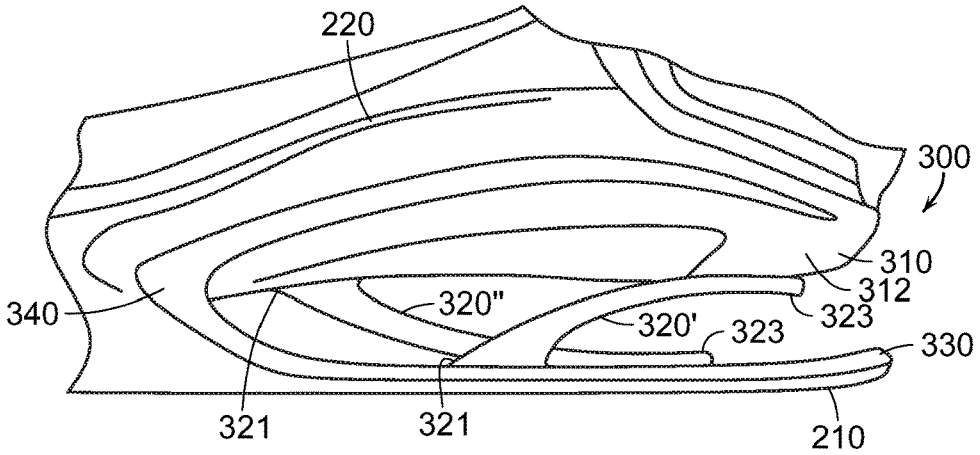
FIG. 5 is a lateral side view of a sole structure in accordance with aspects of this disclosure.
Figure 6:
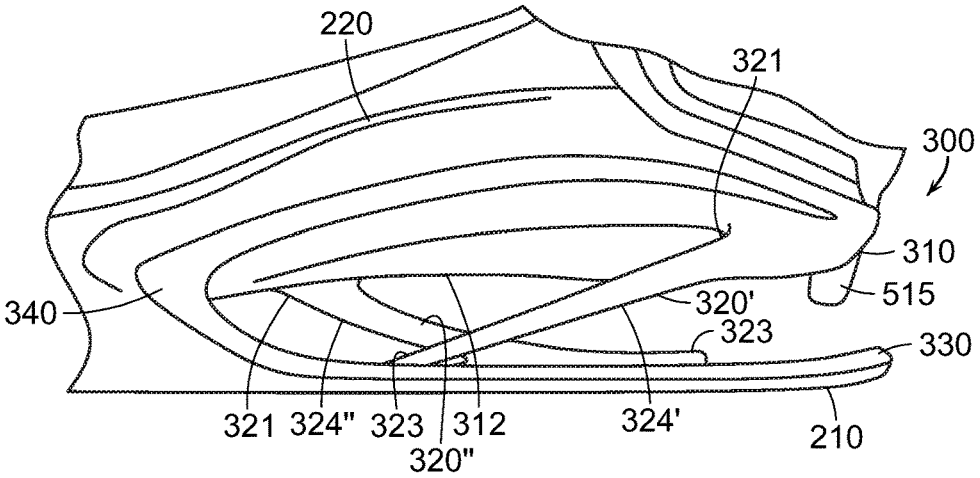
FIG. 6 is a lateral side view of a sole structure in accordance with aspects of this disclosure.

Thus, other arrangements of the flexure elements 320 are within the scope of the invention. For example, as shown in FIG. 4, a single flexure element 320 may extend upward and forward from the lower element 330. This single flexure element 320 may be generally centered on centerline 16. As another example, as shown in FIG. 5, a first flexure element 320' may extend downward and rearward from upper element 310 and a second flexure element 320" may extend upward and rearward from lower element 330. In this embodiment, the first flexure element 320' may be centered on centerline 16, while the second flexure element 320" may be positioned to the lateral side of the first flexure element 320'. As even another example, as shown in FIG. 6, a first pair 324' of flexure elements 320' may extend downward and forward from upper element 310 and a second pair 324" of flexure elements 320" may extend downward and rearward from upper element 310. In this embodiment, the rearwardly extending second pair 324" of flexure elements 320" may be positioned closest to centerline 16. Optionally, in other embodiments, the forwardly extending pair 324' of flexure elements 320' may be positioned closest to centerline 16. Even further, the individual flexure elements 320', 320" of "pairs" of flexure elements 324', 324" need not be located the same distance from centerline 16, i.e., pairs 324', 324" of flexure elements 320 may be offset from centerline 16. Thus it is apparent, given the benefit of this disclosure, that any number of flexure elements 320, having various properties, may be positioned between lower element 330 and upper element 310 in any number of configurations (symmetric or non-symmetric).

Referring to FIGS. 4-6, each flexure element 320 includes an elongated member having a base 321 and an opposed end 323. The base 321 is attached to or integrally formed with a base element, which is at least part of either upper element 310 or lower element 330. Opposed end 323 of flexure element 320 may be a free end configured to slide along the surface of an opposed element, which is the other of upper element 310 or lower element 330. As shown in FIG. 4, flexure element 320 may be an elongated, smoothly curved member. As shown in FIG. 6, one or more of the flexure elements 320 may be (at least initially, i.e., in the unloaded configuration) an elongated, linear member. In this embodiment, the forwardly extending second pair of flexure elements 320 comprise of a linear members.

Thus, an elongated flexure element 320, having a base 321 and an opposed end 323, may be joined at its base 321 to the lower surface of upper element 310 or the upper surface of lower element 330. Flexure element 320 may extend from its base 321 toward a midfoot region 12 of the sole structure 200. Thus, if flexure element 320 is located in the heel region 13, it may extend forwardly from its base 321. If flexure element 320 is located in the forefoot region 11, it may extend rearwardly from its base 321.

According to certain aspects and referring to the embodiments illustrated in FIGS. 1A-1B and FIGS. 2A-2D, flexure elements 320 are joined to and extend from the base element toward the opposed elements without being attached to the opposed elements. In other words, flexure elements 320 need not be attached at their opposed ends 323 to either lower element 330 or to upper element 310, i.e., opposed ends 323 of flexure element 320 may be free ends. Thus, flexure elements 320 may function as cantilevered elements. In general, in the unloaded configuration, i.e., when no vertical compressive load is applied to support assembly structure 300, the free opposed ends 323 of flexure elements 320 may, but need not, contact the opposed, associated surfaces of upper element 310 or lower element 330. In the loaded configuration, the free opposed ends 323 of the cantilevered flexure elements 320 may slidingly contact the opposed element. Further during the loaded configuration, the ends 323 of certain of the flexure elements 320 may slidingly contact the opposed element 310 or 330, and then continue to slide up and away from the surface of the opposed element. Even further, after sliding up and away from the surface of the opposed element 310 or 330, the end 323 may eventually contact the surface of the base element (i.e., the other of the opposed element 310 or 330). For example, a flexure element 320 extending upward from the lower element 330 may have an end 323 that slidingly contacts the lower surface of the upper element 310, but then continues its relative motion to curve back down towards the upper surface of the lower element 330.

Figure 7A:
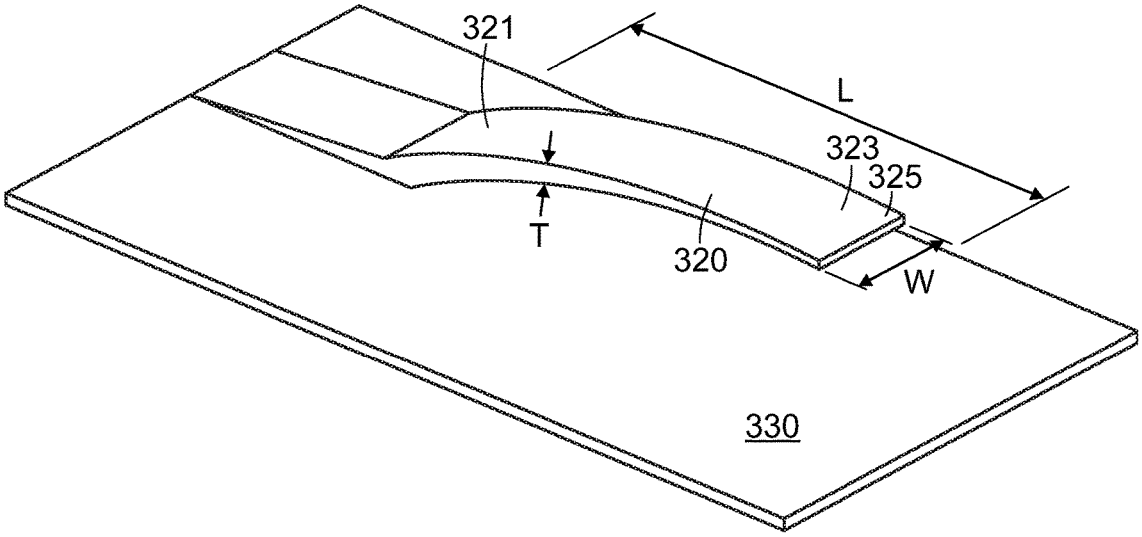
FIGS. 7A-7D are perspective views of various flexure elements in accordance with aspects of this disclosure.

Referring to FIGS. 7A-7D, each flexure element 320 has an associated thickness (T), an associated width (W), cross-sectional area and configuration, an associated length (L), an associated curvature (including linear, piecewise linear, smoothly curved, and/or complexly curved), and associated materials. Each of these properties may differ from individual flexure element 320 to individual flexure element 320. Moreover, each of these properties may vary within any individual flexure element 320. For example, as shown in FIG. 7A, the thickness (T) of flexure element varies along the length. Also as shown in FIG. 7A, flexure element 320 may have a greater cross-sectional area at its base 321, i.e., at its attachment to lower element 330 or to upper element 310, than at its opposed end 323. As another option, flexure element 320 may have a curved or other non-rectangular cross-sectional shape. Further, the cross-sectional shape may vary along the length of the flexure element 320.

Figure 7B:
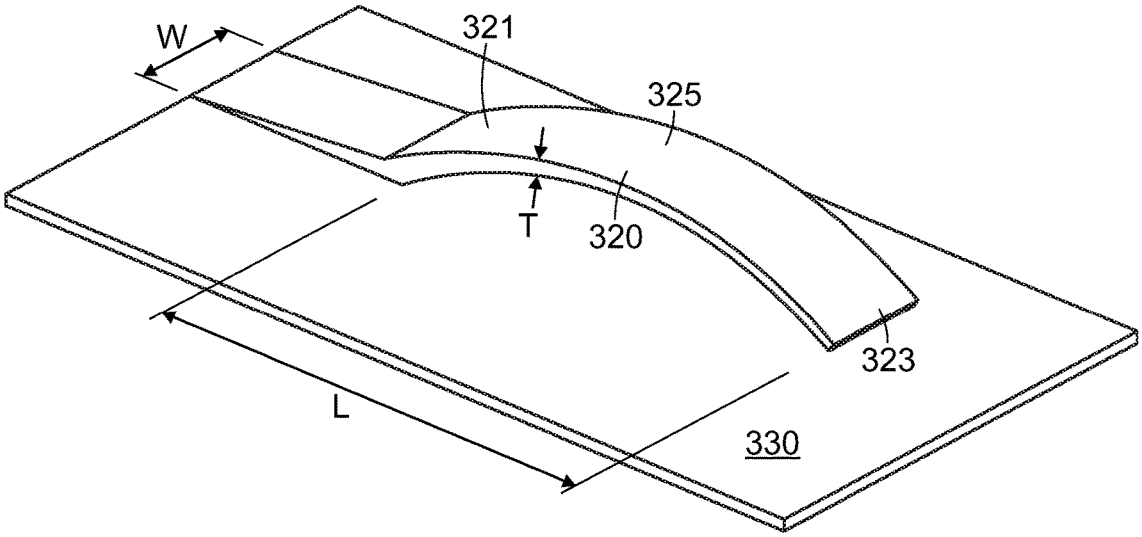
Figure 7C:
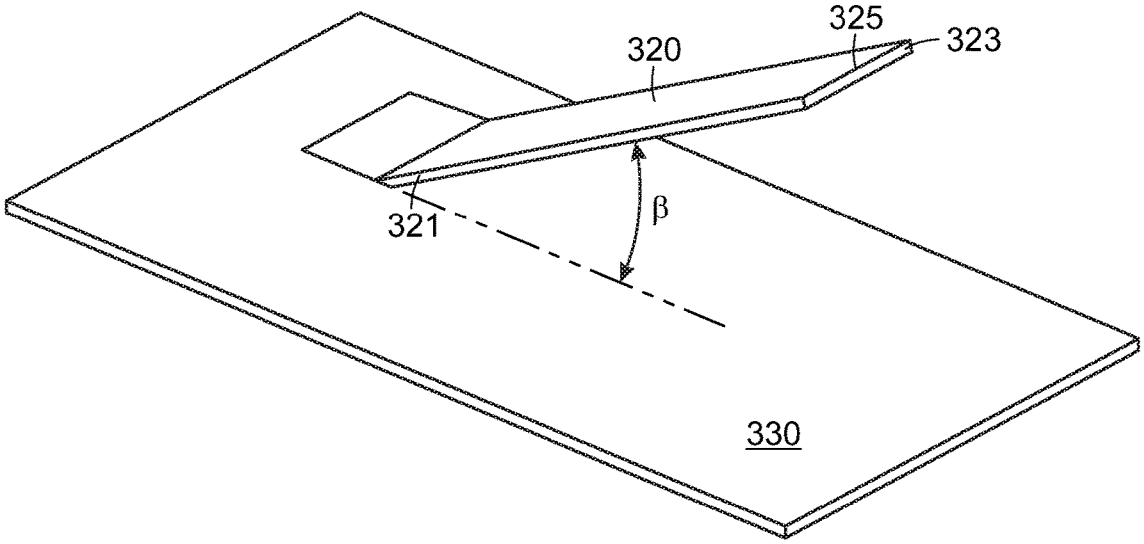
Figure 7D:
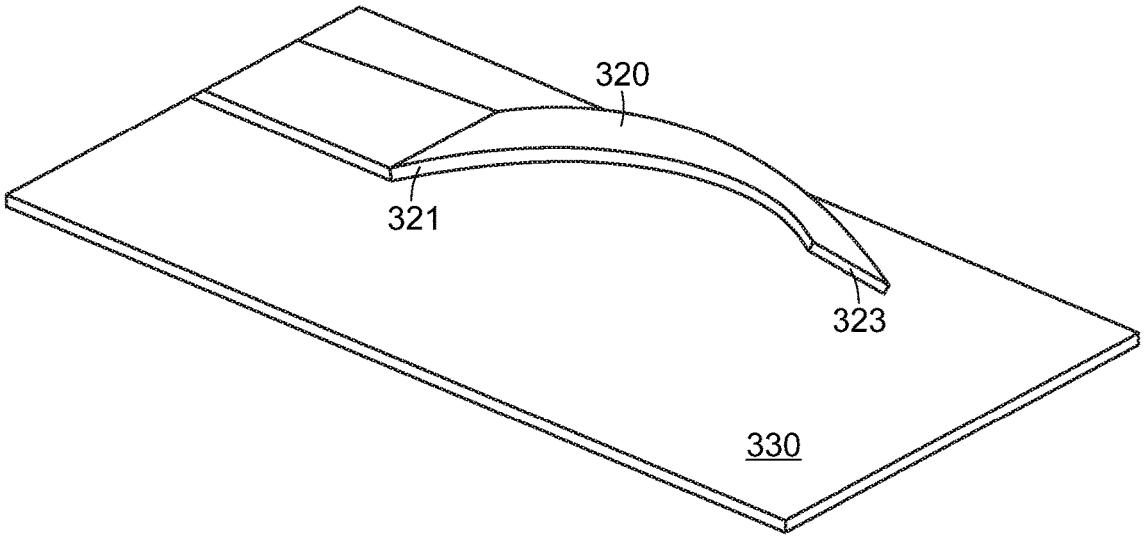

Further, as shown in FIG. 7A, flexure element 320 may have a concavely-curved portion facing the base element (i.e., either upper element 310 or lower element 330). Further, flexure element may have a convexly-curved portion facing the opposing element (i.e., the other of the upper element 310 and the lower element 330). The curvature of flexure element 320 may be such that opposed end 323 may be located at the peak of the curve, i.e., at the farthest perpendicular distance from the base element. Optionally, as shown in FIG. 7B the curvature of flexure element 320 may be such that flexure element 310 curves back toward its base element. In such case, opposed end 323 would not be located the farthest perpendicular distance from the base element. Rather, the peak of the curve may be provided at a point 325. Point 325 is defined as the point on the flexure element 320 that is located the farthest perpendicular distance from the attachment of the flexure element to the base element. According to certain embodiments, the curvature of any of the various flexure elements 320 may vary along its length. This varying curvature may provide the support assembly structure 300 with a multi-stage cushioning characteristic as the flexure elements 320 slide relative to the opposing element. As shown in FIG. 7C, flexure element 320 may be a straight, cantilevered element extending from the base element at an angle β. According to even another embodiment, as shown in FIG. 7D, flexure element 320 may be provided with a twist along its longitudinally extending length. As an option, the twisted flexure elements 320 may be provided in a pre-stressed or pre-tensioned condition, even in an unloaded state.

In general, for curved or straight flexure elements 320, a line may be defined from base 321 of flexure element 320 to point 325. Specifically, the line may extend from the center of the attachment of base 321 to the base element to point 325. This line may be used to determine an angle β of flexure element 320 from the base element. Angle β, measured in an unloaded configuration, is an acute angle that may range from 5 to 85 degrees. More preferably, angle β may range from 10 to 70 degrees, from 20 to 60 degrees, or even from 20 to 45 degrees. In general, the shallower the angle β, the less stiff will be the flexure element (all other things being equal).

Thus, flexure elements 320 may be formed as a generally plate-like element (either straight or curved). Such plate-like flexure elements 320 would typically have a first (out-of-plane) bending moment that is less than a second (in-plane) bending moment. In other words, a plate-like flexure element 320 may be more flexible and have a lower stiffness when reacting to compression loads (when oriented as shown in FIGS. 7A-7C) and less flexible and having a higher stiffness when reacting to transverse loads. Optionally, flexure elements 320 may be less plate-like and more beam-like, i.e., having similar flexibilities/stiffnesses in the vertical and transverse loading configurations. Further, any given flexure element 320 may have symmetric properties or non-symmetric properties. Non-symmetric properties may result in twisting of the flexure element 320 when it is subjected to loading.

Referring again to the particular embodiment illustrated in FIGS. 1A-1B and FIGS. 2A-2D, support assembly structure 300 also includes an upper element 310 and a lower element 330. Support assembly structure 300 may be formed as an integral component. For example, upper element 310, lower element 330 and the one or more flexure elements 320 may be formed separately and subsequently permanently attached to one another. In certain embodiments, support assembly structure 300 may be formed as a unitary component. For example, upper element 310, lower element 330 and the one or more flexure elements 320 may be injection molded as a single unit.

Upper element 310 and lower element 330 may be joined at a common end 340. Common end 340 may generally be located in a midfoot region 12. As shown in FIG. 1A, upper element 310, lower element 330 and common end 340 may form a generally V-shaped structure. Upper element 310 and lower element 330 form the legs of the V-shape and common end 340 forms the vertex of the V-shape. Generally, common end 340 may have a greater thickness than other portions of the support assembly structure 300.

Common end 340 may function as a spring, in that loads tending to open or close support assembly structure 300 may be elastically resisted, in part, by the inherent stiffness of common end 340. Upper element 310 and lower element 330 may each be cantilevered or quasi-cantilevered from common end 340. Alternatively, common end 340 may function as a clamshell-like or pinned hinge, allowing upper element 310 and lower element 330 to essentially freely rotate relative to one another at the common end 340. In such case, resistance to the opening and closing of the support assembly structure 300 may be provided, in part, by the inherent stiffness of the portions of the footwear 10 attached to common end 340 and/or to the remainder of the support assembly structure 300. In certain embodiments, common end 340 may be formed separately from one and/or the other of upper element 310 and lower element 330, and subsequently joined to upper element 310 and/or lower element 330. In other embodiments, common end 340 may be unitarily formed with one and/or the other of upper element 310 and lower element 330. As an example, common end 340 may be formed as a living hinge. In such case, upper element 310, lower element 330 and common end 340 may be molded as an essentially planar element which is subsequently folded over on itself (like a wallet) upon removal from the mold.

According to even other embodiments, upper element 310 and lower element 330 need not be joined at a common end. Thus, for example, upper element 310 may be attached to a portion of midsole structure 220 and lower element 330 may be attached to a portion of outsole structure 210, and midsole structure 220 and outsole structure 210 may be joined to one another (directly or indirectly) beyond the ends of upper element 310 and lower element 330.

As shown in the embodiment of FIGS. 1A-1B and particularly in FIG. 1B, upper element 310 may extend from lateral edge 17 to medial edge 18 of sole structure 200. In some embodiments, upper element 310 may extend only partially across the width of sole structure 200. By way of certain examples, upper element 310 may extend over less than 90% of the width of sole structure 200, over less than 75% of the width of sole structure 200, or even over less than 50% of the width of sole structure 200. In certain embodiments, upper element 310 may be approximately centered within the width of sole structure 200. In certain other embodiments, upper element 310 may be shifted toward the lateral side (or toward the medial side) of sole structure 200.

Further, in some embodiments, upper element 310, when located within heel region 13, may extend from the rearward edge of heel region 13 forward into midfoot region 12. In other embodiments, upper element 310 may extend only along the longitudinal length of heel region 13, or even only partially along the longitudinal length of heel region 13.

Referring to the embodiments illustrated in FIGS. 2A-2D and FIGS. 4-6, upper element 310 includes a plate 312. Plate 312 may be flat (or substantially flat) or it may be contoured. For example, the upper surface of plate 312 may generally follow the contour of a portion of the sole of the foot. Further, plate 312 may be oriented generally horizontal, i.e., within plus/minus approximately 5 degrees from the horizontal. Optionally, plate 312 may extend upward (i.e., slant upward in the midfoot-to-heel direction) at an overall angle of less than approximately 10 degrees for relatively low heels, at an angle of less than approximately 20 degrees for moderately raised heels, or at an angle of less than approximately 30 degrees for relatively high heels. A single plate 312 may be provided that extends from the lateral to the medial side of upper element 310. Alternatively, more than one plate 312 may be provided. As an example, a central plate element with medial-side and lateral-side plate elements may be provided. This decoupling, or partial decoupling, of the sides of upper element 310 from its central portion may provide greater design flexibility of the support assembly structure 300.

Referring to FIGS. 1B and 2A-2C, upper element 310 may include a lateral sidewall 314 and a medial sidewall 316. Lateral sidewall 314 extends at least partially along the length of the lateral edge of plate 312. Similarly, medial sidewall 316 extends at least partially along the length of the medial edge of plate 312. Upper element 310 may also include a transverse wall 318 that extends at least partially along the length of a transverse (rear) edge of plate 312. Further, according to certain embodiments, lateral sidewall 314, transverse wall 318 and medial sidewall 316 may be joined together so as to form a single continuous wall. Sidewalls 314, 316 and/or transverse wall 318 may be formed as flanges that project upward or downward from plate 312. A continuous upwardly projecting flange may be formed by these upwardly projecting walls 314, 316, 318. This upwardly projecting flange may wrap around heel region 13 such that upper element 310 may be configured similar to a heel cup. These upwardly projecting flanges may assist in securing upper element 310 to upper 100.

Upper element 310 may be formed separately from upper 100 and subsequently attached to upper 100 in any conventionally known fashion (e.g., by adhesives, cements, fusing techniques, mechanical connectors, etc.). As one example, upper element 310 may be injection molded onto upper 100. Further, other midsole elements, such as a separate heel cup or a midsole insert 222 (see FIGS. 2A-2C), may be provided between upper 100 and upper element 310. In such case, upper element 310 may be attached to upper 100 indirectly (i.e., via intervening heel cup or midsole insert 222) in any conventionally known fashion (e.g., by adhesives, cements, fusing techniques, mechanical connectors, etc.). Alternatively, upper element 310 may be unitarily formed with other possible components forming sole structure 200. For example, upper element 310 may be injection molded in a single operation (or, optionally, co-molded) with midsole structure 220 or other midsole components, such as a heel cup structure.

As shown in the embodiment of FIGS. 1A-1B, lower element 330 may extend from lateral edge 17 to medial edge 18 of sole structure 200. In some embodiments, lower element 330 may extend only partially across the width of sole structure 200. By way of certain examples, lower element 330 may extend over less than 90% of the width of sole structure 200, over less than 75% of the width of sole structure 200, or even over less than 50% of the width of sole structure 200. In certain embodiments, lower element 330 may be approximately centered within the width of sole structure 200. In certain other embodiments, lower element 330 may be shifted toward the lateral side (or toward the medial side) of sole structure 200. Further, similar to upper element 310, in some embodiments, lower element 330 when located within heel region 13 may extend from the rearward edge of heel region 13 forward into midfoot region 12. In other embodiments, lower element 330 may extend only along the longitudinal length of heel region 13, or even only partially along the longitudinal length of heel region 13.

Lower element 330 may be flat (or substantially flat) or it may be contoured. For example, lower element 330 may include one or more stiffened and/or reinforced areas. Lower element 330 will typically be oriented generally horizontal, i.e., within plus/minus approximately 5 degrees from the horizontal.

Lower element 330 may be provided as one or more plate elements. For example, a single lower element 330 may be provided that extends from the lateral to the medial side of outsole structure 210. Alternatively, more than one lower element component may be provided. As an example and referring to FIGS. 1B and 2A, a lateral lower element component 330*a* and a medial lower element component 330*b* may be provided. Decoupling, or partially decoupling, of the lateral side of lower element 330 from its medial side provides greater flexibility in the support assembly structure 300 and in the overall sole structure 200.

Lower element 330 may be formed separately from outsole structure 210 and subsequently attached to outsole structure 210 in any conventionally known fashion (e.g., by adhesives, cements, fusing techniques, mechanical connectors, etc.). Alternatively, lower element 330 may be unitarily formed with or as part of outsole structure 210. If lower element 330 is formed as one or more separate plate elements, e.g., 330*a*, 330*b*, then outsole structure 210 may extend across any gaps formed between the separate plate elements 330*a*, 330*b*. Alternatively, outsole structure 210 may be provided with corresponding slots that generally align with the gap(s) formed between the separate plate elements 330*a*, 330*b*, such that portions of outsole structure 210 may be decoupled, or partially decoupled, from other portions. Even further, according to certain embodiments, lower element 330 may directly contact the ground as an outsole member. Thus, lower element 330 may be formed from a durable, outsole-type material. A ground-contacting layer to provide traction or abrasion resistance may be attached directly to the underside of lower element 330.

According to certain aspects, flexure elements 320 may be constrained or partially constrained in one or more degrees of freedom (translation and/or rotation). For example, one or more constraint elements may be provided on support assembly structure 300 to guide or limit the movement of flexure elements 320. As a more specific example, constraint elements may serve to at least partially constrain the motion, either displacement or rotation, of ends 323. None, some, or all of flexure elements 320 may be guided by constraint elements.

Figure 8A:
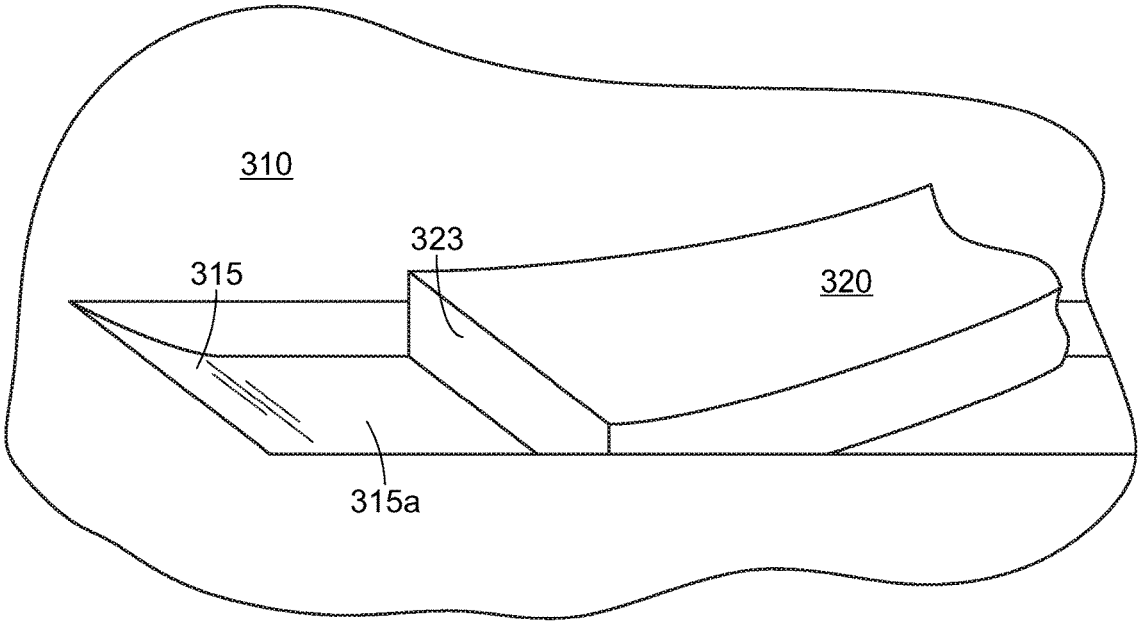
FIG. 8A is a perspective view of a detail of the interaction of a flexure element with a constraint element in accordance with aspects of this disclosure.
Figure 8B:
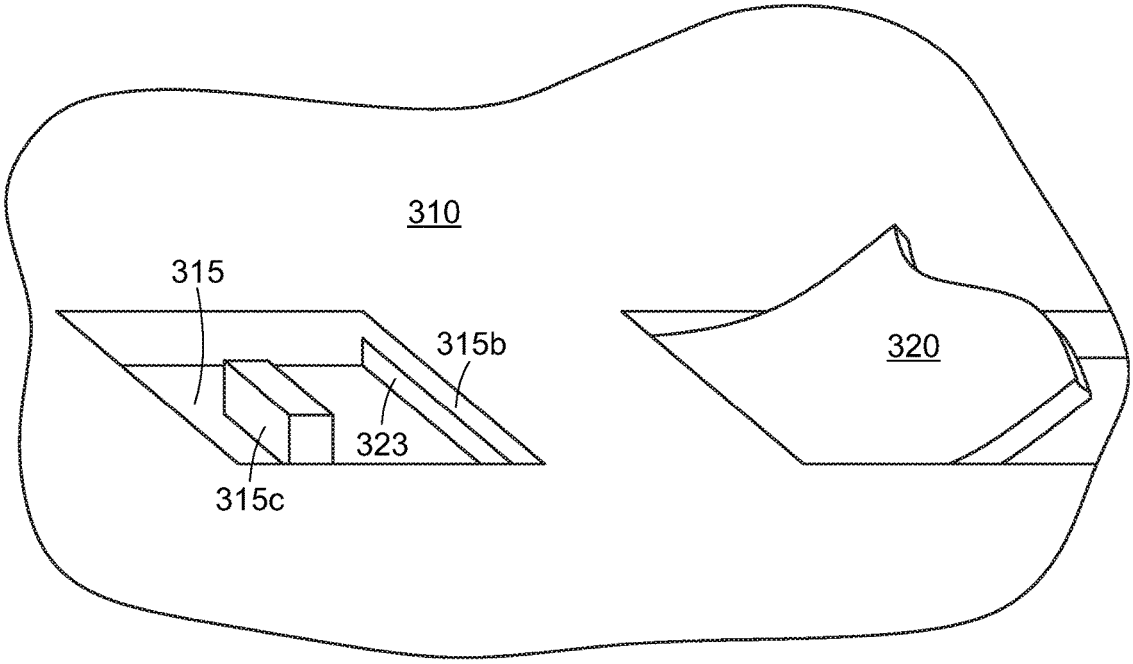
FIG. 8B is a perspective view of a detail of the interaction of a flexure element with other constraint elements in accordance with aspects of this disclosure.

According to one embodiment and referring to FIG. 8A, upper element 310 may be provided with a constraint element 315 configured as an elongated track-like guiding element 315*a*. End 323 may slide lengthwise within the track-like guiding element 315*a*, but it may be constrained from sliding sideways, relative to the elongated length, by the side walls of track-like guiding element 315*a*. Track-like guiding element 315*a* may lie essentially in the plane of upper element 310 or it may curve, thereby directing end 323 to move away from upper element 310. According to another example embodiment and referring to FIG. 8B, upper element 310 may be provided with a constraint element 315 configured as a covered (or partially covered) track-like guiding element 315*b*. According to this example, end 323 may slide lengthwise within the covered track-like guiding element 315*b*, but may be constrained from sliding sideways, and further, may be constrained by the cover from riding up out of the covered track-like guiding element 315*b*. According to even another embodiment, as also shown in FIG. 8B, constraint element 315 may be configured as a stop 315*c*. Thus, for example, end 323 may be allowed to initially move freely within the track until it contacts stop 315*c*. Stop 315*c* may be located on the surface of upper element 310 or, by way of another example, within track-like guiding element. Other constraint elements, as would be apparent to persons of ordinary skill in the art, given the benefits of this disclosure, may also be provided.

Similarly, one or more constraint elements may be provided on lower element 330 to guide or limit the movement of flexure elements 320 and/or ends 323 of those flexure elements 320 extending downward from upper element 310.

According to even other aspects and as illustrated in FIG. 6, an arrest element 515 may be provided to limit the displacement or arrest the movement of upper element 310 relative to lower element 330. Arrest element 515 may include a block attached to (or unitarily formed with) upper element 310 and having a free end extending toward lower element 330 (or vice versa). In the unloaded configuration of support assembly structure 300, the free end of arrest element 515 will not be in contact with lower element 330, but rather will be spaced a distance from lower element 330. In the loaded configuration, only after upper plate 310 and lower element 330 close the gap will arrest element 515 start to limit the relative displacement. Arrest element 515 may include an elastomeric material. Optionally, more than one arrest element 515 may be provided. Further, arrest element 515 may be provided to limit the relative displacement of upper element 310 to lower element 330 in the downward direction, in the lateral direction and/or in the longitudinal direction. Thus, for some configurations arrest element 515 may primarily experience compressive loads, while in other configurations arrest element 515 may primarily experience shear loads.

Figure 9A:
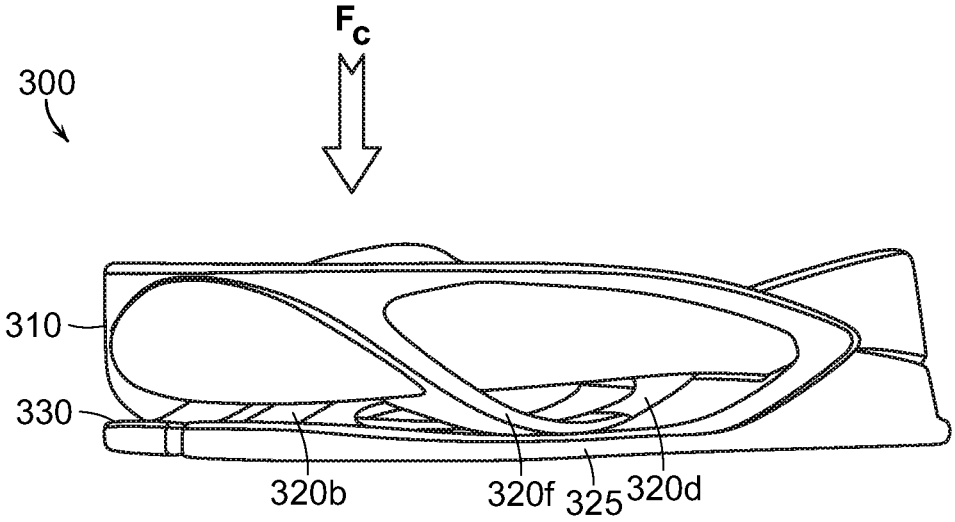
FIG. 9A is a perspective view of the sole structure of FIG. 2A showing the configuration of the sole structure when a vertical compressive force is applied.
Figure 9B:
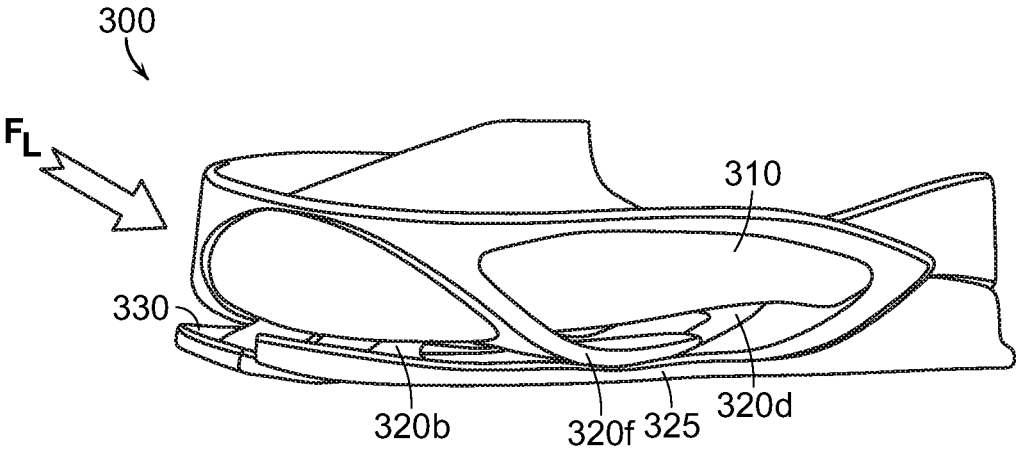
FIG. 9B is a perspective view of a sole structure of FIG. 2A showing the configuration of the sole structure when a vertical compressive force and a lateral force is applied.

As shown in FIGS. 1A and 1B and in FIG. 2A-2D, upper element 310 is positioned above lower element 330 with curved cantilevered flexure elements 320 extending therebetween. In operation, and referring to FIG. 2A, 2D and also to FIGS. 9A-9B, when a vertical compressive force ($F_C$) is applied downward to upper element 310 (for example, by the heel of a user of the article of footwear 10), upper element 310 moves downward and cantilevered flexure elements 320*c*, 320*d*, 320*e*, 320*f* bend at the same time that their corresponding opposed ends 323 slidingly contact and move along the upper surface of lower element 330. Similarly, cantilevered flexure elements 320*a*, 320*b* bend at the same time that their corresponding opposed ends 323 slidingly contact and move along the lower surface of upper element 310. In this particular embodiment there are no constraint elements to limit the displacements of the flexure elements 320 and/or opposed ends 323.

Figure 2A:
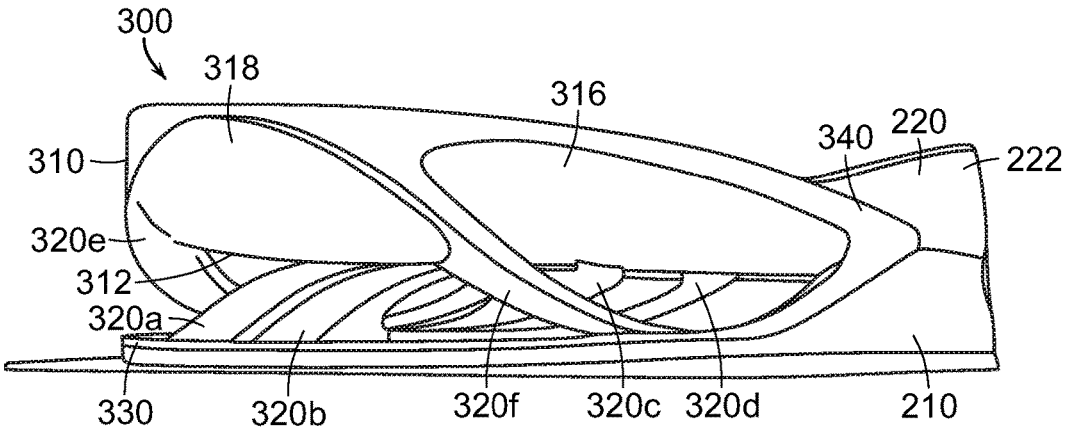
FIG. 2A is a perspective view of a sole structure in accordance with aspects of this disclosure.
Figure 2B:
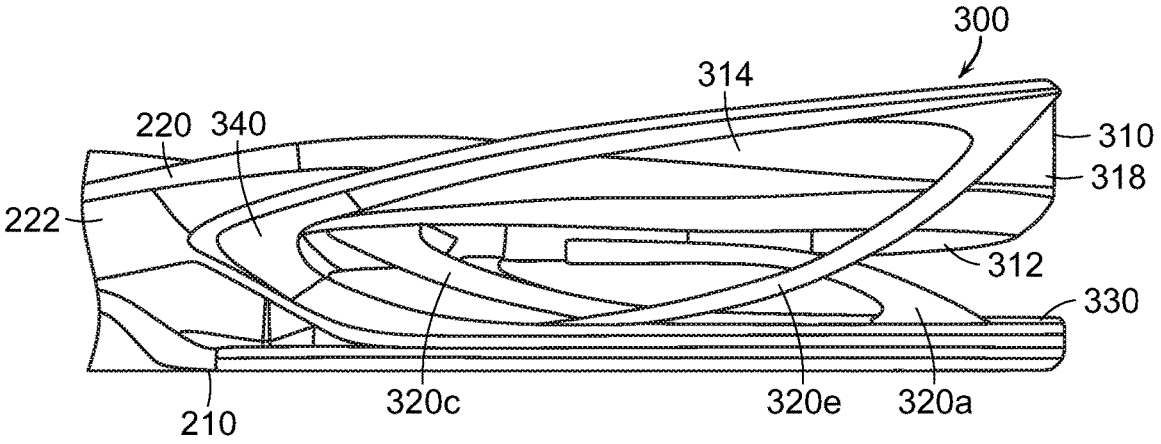
FIG. 2B is a lateral side view of the sole structure of FIG. 2A.
Figure 2C:
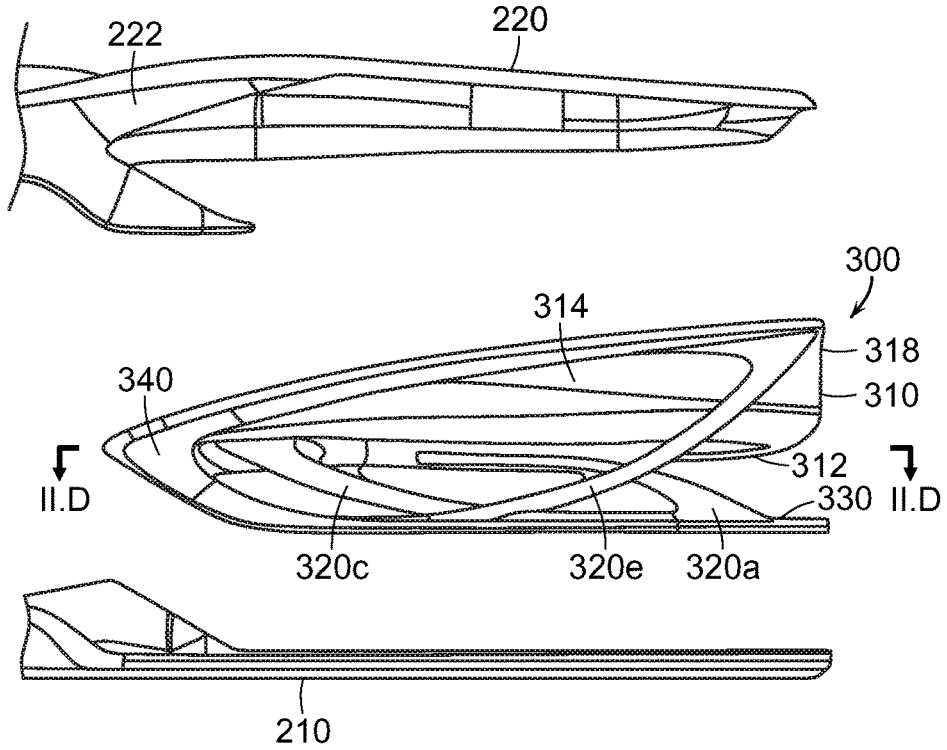
FIG. 2C is an exploded perspective view of the sole structure of FIG. 2A
Figure 2D:
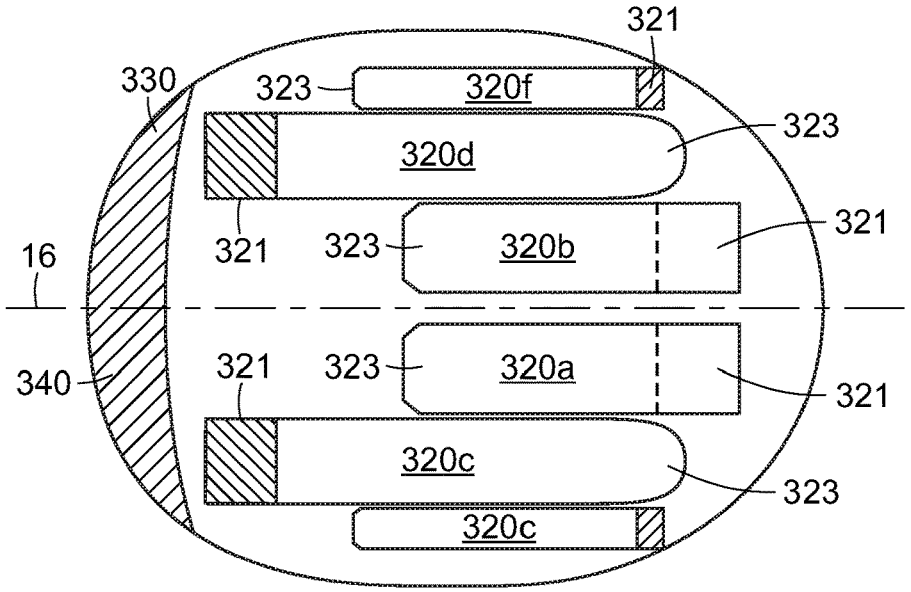
FIG. 2D is a schematic cross-section of the sole structure of FIG. 2A, taken through section II.D-II.D of FIG. 2C.
Figure 3:
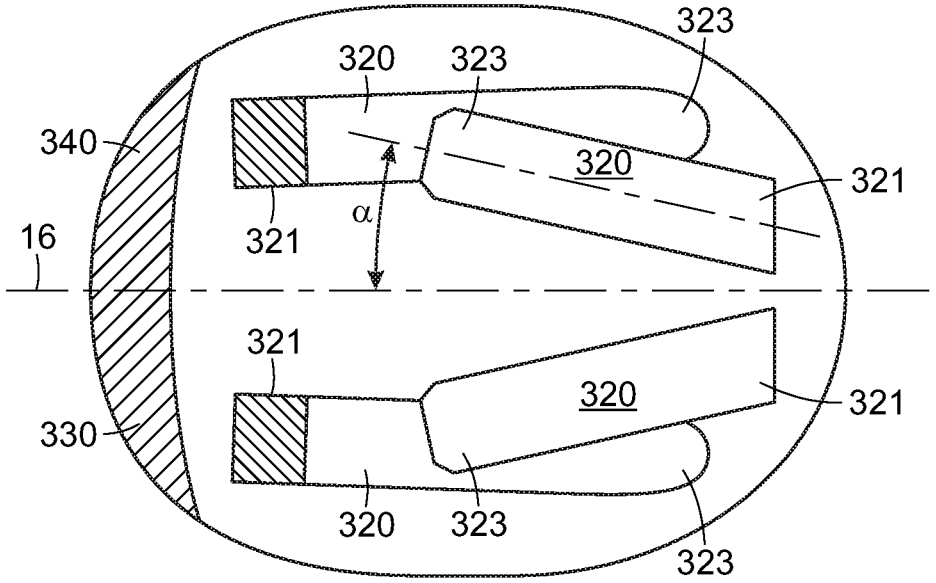
FIG. 3 is a schematic cross-section of a sole structure in accordance with aspects of this disclosure.

When lateral (or sideways) force ($F_L$) is applied to the upper element 310, upper element 310 displaces sideways relative to lower element 330. At the same time, the cantilevered flexure elements 320*c*, 320*d*, 320*e*, 320*f* extending downward from the upper element 310 displace laterally relative to the cantilevered flexure elements 320*a*, 320*b* extending upward from lower element 330. Referring to FIG. 2D, it can be seen that flexure elements 320*a*, 320*b* overlap lengthwise with flexure elements 320*c*, 320*d* along at least a portion of their length. Similarly, flexure elements 320*c*, 320*d* overlap lengthwise with flexure elements 320*e*, 320*f* along at least a portion of their length. After a given lateral displacement, the gaps, if any, between adjacent, overlapped flexure elements 320 may be closed and the edges of certain laterally adjacent flexure elements 320, i.e., those laterally adjacent flexure elements 320 that extend lengthwise alongside each other, may bear on each other. (If these adjacent crossed flexure elements 320 are in contact with each other in the unloaded configuration, then the lateral displacement for the lengthwise overlapped flexure elements 320 to bear on each other is essentially zero.) If lateral loads are reacted in this manner, it is expected that a small amount of lateral displacement of the loaded flexure elements 320 may occur. This sideways loading of the interlocking or lengthwise overlapping flexure elements 320 may thus provide an additional load path for reacting the lateral loads.

Further, when a downward compressive force $F_C$ is applied, the distance between the upper element 310 and the lower element 330 decreases. Thus, the distance between the bases 321 of adjacent, overlapped flexure elements 320 also decreases. Thus, when a compressive force $F_C$ is applied in conjunction with a lateral force $F_L$, the point where the adjacent, overlapped flexure elements 320 bear on one another moves closer to the respective bases of the flexure elements 320. This, in turn, may create a stiffer lateral load path (as compared to $F_C$=0). In other words, the stiffness of the lateral load path may tend to increase as the downward compressive force $F_C$ increases. This stiffening effect may be even more pronounced if the cross-sections of the individual flexure elements 320 increase as they approach their bases 321. The lateral stiffness of the support assembly structure 300 is a function of, among other things, the lateral gap between laterally adjacent, lengthwise overlapped flexure elements 320, the lateral stiffness of the individual flexure elements 320, and the point where the edges of the crossed (overlapped) flexure elements 320 bear on each other.

Thus, it can be seen, given the benefits of this disclosure, that the downward compressive stiffness of the support assembly structure 300 may be essentially decoupled from the lateral stiffness of the support assembly structure 300. Alternatively, it can be seen, given the benefits of this disclosure, that the structural parameters of the components of the support assembly structure 300 can be varied to achieve a desired downward stiffness, a desired lateral stiffness, and a desired degree of interaction.

According to some aspects, flexure elements 320 are cantilevered elements having a vertical load applied to their opposed ends 323 when support assembly structure 300 is compressed. According to certain other aspects, the vertical load need not be applied at their opposed ends 323, but rather the vertical load may be applied to a point 325 between the base 321 and the opposed end 323. For example, referring to FIG. 7B, a portion of a curved flexure element 320 may extend distally beyond the point of vertical load application 325. Further, this point of vertical load application 325 may change or shift along the length of the flexure element 320 as a compressive load is applied. For example, referring to FIGS. 2A and 9A, when a downward compressive force ($F_C$) is applied to the support assembly structure 300 and the upper element 310 moves toward the lower element 330, curved flexure element **320*f* contacts and slides along lower element 330. As the load ($F_C$) is increased, the point 325 shifts closer to the base 321 of flexure element 320*f*. The portion of curved flexure element 320*f* that extends distally beyond the point 325 curls back up toward the upper element 310. If this distal portion is long enough and/or if the applied compressive force ($F_C$) is great enough, then the opposed end 323 may curl around enough to eventually contact the lower surface of upper element 310**. Thus, another load path may be established to react the compressive force ($F_C$).

Figure 10:
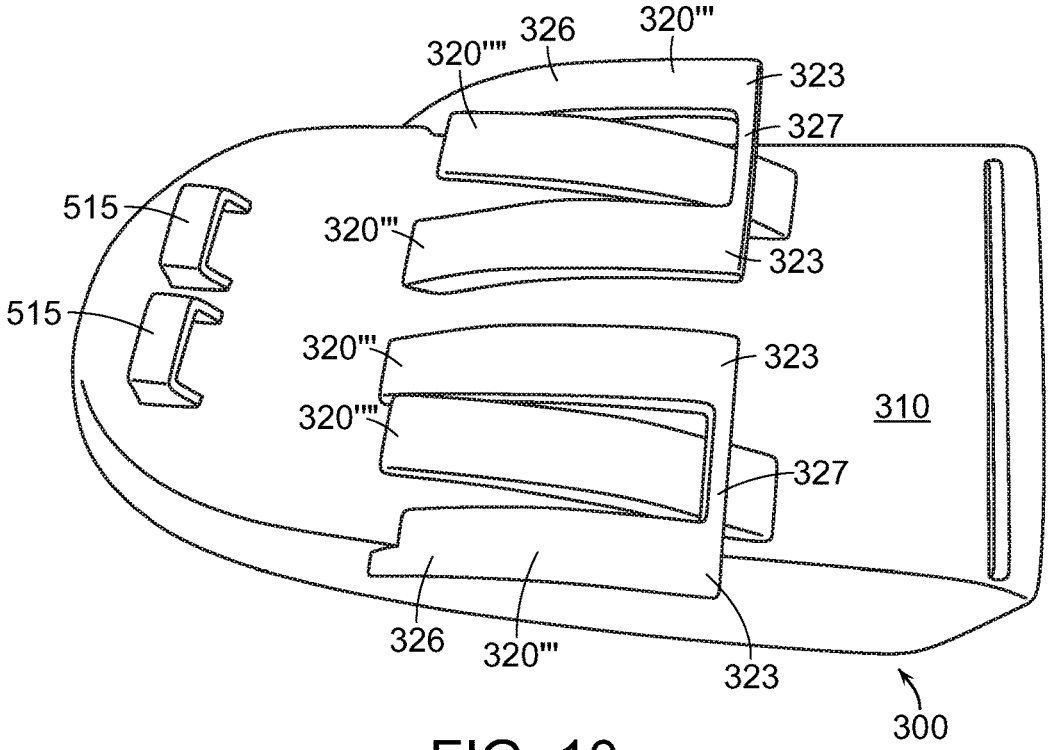
FIG. 10 is a perspective view of an embodiment of an upper element with flexure elements extending therefrom for a support assembly structure element in accordance with aspects of this disclosure.

FIG. 10 illustrates an alternative embodiment of a support structure assembly 300 configured for placement in a heel region of an article of footwear. In FIG. 10, the upper element 310 is being viewed with its lower surface facing upward. Upper element 310 is generally formed as a flat plate with a flange extending around the lateral, rear and medial perimeter edges of the plate. In this embodiment, upper element 310 is provided with four forwardly extending flexure elements 320''' and two rearwardly extending flexure elements 320''''. The flexure elements are arranged parallel to one another at generally the same rear-to-front region of the support assembly structure 300. Further, the flexure elements are generally symmetrically arranged with respect to a rear-to-front longitudinal axis. The forwardly extending flexure elements 320''' are arranged in pairs 326 wherein the opposed ends 323 are joined to each other with couplings 327. Each forwardly extending flexure element 320''' of the pairs 326 flanks one of the rearwardly extending flexure elements 320''''. In this example embodiment, the coupling 327 extends over the base of the rearwardly extending flexure elements 320'''' and may, under certain load conditions, come into contact with this portion of the flanked element. Joining or coupling the ends of the flexure elements minimizes independent motions of those joined elements and, as such, may provide additional stability to the support structure assembly 300. Optionally, two or more flexure elements 320 may be joined anywhere along their lengths. A pair of arrest elements 515 is provided on the lower surface of the upper element 310 toward the rear edge of the support structure assembly 300. Upper element 310, flexure elements 320 and arrest elements 515 are unitarily formed in this specific embodiment.

Figure 11:
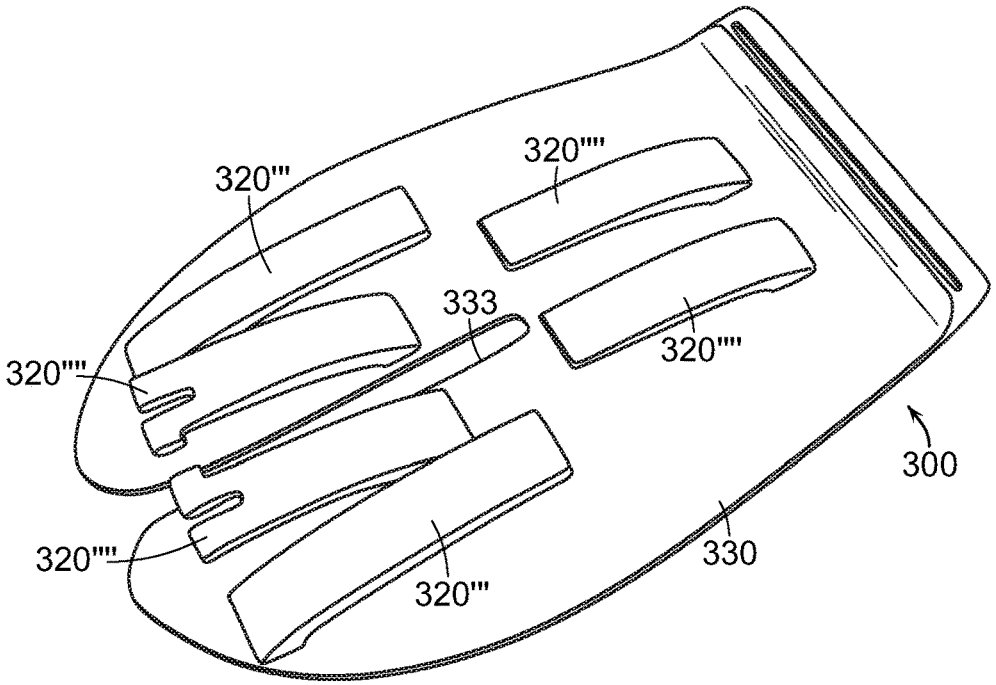
FIG. 11 is a perspective view of an embodiment of a lower element with flexure elements extending therefrom for a support assembly structure element in accordance with aspects of this disclosure.

FIG. 11 illustrates a further alternative embodiment of a support structure assembly 300 configured for placement in a heel region of an article of footwear. A lower element 330 is provided with two forwardly extending flexure elements 320''' and four rearwardly extending flexure elements 320''''. The forwardly extending flexure elements 320''' are generally symmetrically arranged on the lateral and medial sides of the lower element 330. First and second pairs of the rearwardly extending flexure elements 320'''' are also generally symmetrically arranged on the lateral and medial sides of the lower element 330. The first pair of rearwardly extending flexure elements 320'''' is positioned between the pair of forwardly extending flexure elements 320'''. The second pair of rearwardly extending flexure elements 320'''' is positioned forward of the first pair of rearwardly extending flexure elements 320''''. Thus, the forwardly extending flexure elements 320''' are located farther from the longitudinal centerline of the lower element than the rearwardly extending flexure elements 320''''. Further, in this particular embodiment, the forwardly extending flexure elements are longer than the rearwardly extending flexure elements 320''''. The lower element 330 is provided with a slot 333 extending longitudinally from the rear edge of the lower element. This allows the rearward medial and lateral portions of lower element 330 to flex somewhat independently of each other.

Figure 12:
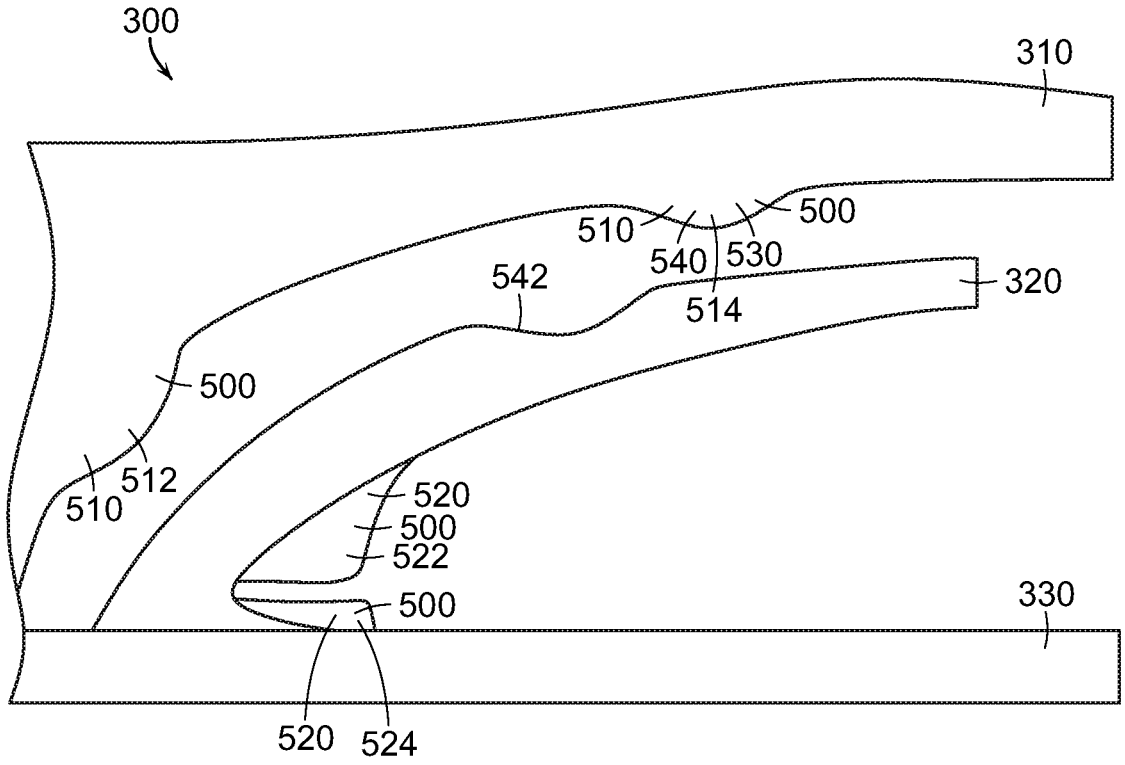
FIG. 12 is a lateral view of an embodiment of a portion of a support assembly structure element in accordance with aspects of this disclosure.

Finally, FIG. 12 illustrates a portion of another embodiment of a support structure assembly 300, wherein various features modify the interaction between the upper and lower elements 310, 330 and the flexure element 320 when the support structure assembly 300 is loaded. For example, portions of the upper element 310 may project beyond its relatively planar lower surface; portions of the lower element 330 may project beyond its relatively planar lower surface; and/or portions of the flexure element 320 may project beyond their nominal relatively planar surface. These projecting portions 500 may function as displacement limiters 510, force limiters 520, sliding guides 530, locking elements 540 and/or sliding resistance elements 550. Projecting portions 500 may be complementarily paired with depressions, notches, slots, etc. Further, these projecting portions may be unitarily formed with the upper, lower and/or flexure elements or they may be provided as attachments. According to some embodiments, such attachments may be optionally attached and/or detached to allow a user to customize the stiffness and/or displacement characteristics of the support structure assembly 300. Even further, any one projecting portion may provide more than one function.

Displacement limiters 510 may be designed to limit relative displacement of the upper element 310 to the lower element 330 during the latter stages of the loading of the support structure assembly 330. Such displacement limiters 510 may be relative stiff, such that when they are engaged there is essentially no relative displacement in the engaged direction. For example, in FIG. 12 a relatively smooth bump 512 is provided on the lower surface of the upper element 310 in the vicinity of the base portion of the flexure element 320. When sufficient downward load is applied to the upper element 310, bump 512 contacts (i.e., engages) the upper surface of flexure element 320. Further downward displacement of upper element 310 is directly transmitted to flexure element 320 at bump 512, and thus relative motion between upper element 310 and the flexure element 320 in the engagement direction is eliminated. However, relative sliding between the bump 512 and the flexure element 320, i.e., relative motion transverse to the direction of engagement may still occur. A second relatively smooth bump 514 which interacts with the flexure element 320 closer to the free end 323 is also shown. Depending upon the loaded/displaced configuration assumed by the support structure assembly 300, bump 514 may interact (i.e., engage) a depression 542 in the upper surface of the flexure element 320. Depending upon the specific geometries of the bump 514 and the depression 542, these elements may function as a locking element 540 or more as a sliding resistance element 550. Other friction-type, detent-type, ratchet-type, etc. configurations may be provided to releasably lock or resist relative movement between the various components.

Force limiters 520 may be provided as spring elements, elastomeric elements, foamed elements, gel cushions, airbags, etc. These elements still allow relative motion between the various components, but they also provide a path for loads to be transmitted between the elements. In some embodiments, such force limiters 520 may also function as force attenuating elements such that loads, and particularly impact loads, may be dissipated or at least partially dissipated. For example, a relative stiff elastomeric element 522 may project from an underside of a flexure element 320. This elastomeric element may function as a bumper in that shock loads may be attenuated, while at the same time a significant portion of the loads may be reflected and/or recovered. A further elastomeric element 524, designed to interact with the first elastomeric element 522, may be located on the upper surface of lower element 330.

As noted above, flexure elements 320 may be unitarily formed with one and/or the other of upper element 310 and lower element 330. Alternatively, flexure element 320 may be formed separately from upper element 310 and/or lower element 330 and subsequently attached thereto at an attachment region. The attachment region may include additional elements imparting impact attenuation, force recovery, stretch, tension and/or other stiffness, force and/or displacement characteristics in one or more directions. For example, the base of the flexure element 320 may engage a foamed attachment region element having isotropic characteristics, an elastomeric attachment region element having isotropic characteristics, an elastomeric attachment region element provided with anisotropic characteristics, and/or an assemblage of attachment region elements designed to provide anisotropic stiffness, force, and/or displacement characteristics. The attachment region elements, if any, may be embedded or partially embedded in the upper and/or lower elements 310, 330. Optionally, the attachment regions elements, if any, may be provided on the surface(s) of the upper and/or lower elements 310, 330. Thus, the attachment region may provide a modified or augmented response of the flexure elements 320 as they engage the other components of the support assembly structure 300.

Flexure element 320 may be formed of a relatively lightweight, relatively stiff material. For example, flexure element 320 may be formed of plastics, such as PEBAX® (a poly-ether-block co-polyamide polymer available from Atofina Corporation of Puteaux, France), silicone, thermoplastic polyurethane (TPU), polypropylene, polyethylene, ethylvinylacetate, and styrene ethylbutylene styrene, etc. Optionally, the material of flexure element 320 may also include fillers or other components to tailor its hardness, wear, durability, abrasion-resistance, compressibility, stiffness and/or strength properties. Thus, for example, flexure element 320 may include reinforcing fibers, such as carbon fibers, glass fibers, graphite fibers, aramid fibers, basalt fibers, etc. One particular material for use in flexure elements 320 may be Grilamid® LV-23H, a polyamide with a 23% glass fiber fill (supplied by EMS-GRIVORY). Optionally, flexure elements 320 and/or portions thereof could be provided as a foamed material. For example, with an injection molded foamed plastic it may be possible and desirable to form thin portions that are relatively solid and hard and thicker portions that are more foam-like and thus more compliant. Even further, flexure element 320 may include one or more metal elements or subcomponents. Such metal subcomponents may be particularly suitable in high stress, high strain areas of the flexure element 320.

Flexure element 320 may be formed of a single material as a single layer. For example, flexure element 320 may be unitarily formed during single molding operation. According to certain aspects, flexure element 320 may be formed of more than one layer, wherein the different layers may be formed of different materials. In general, flexure element 320 may be formed of any number of layers (or other sub-elements) and of any number of materials. Thus, portions of flexure element 320 and/or portions of its layers may be separately formed and subsequently permanently joined to each other to form an integral component. For example, flexure elements 320 may include a metal (such as spring steel) or other relatively strong, flexible material as a skeleton or central spine, around which polymeric materials of flexure element 320 are co-molded or otherwise formed and secured. Optionally, however, flexure element 320 and/or its sub-elements need not be integrally formed. For example, flexure element 320 may include a central metal spine that slides within an outer elastomeric sheath.

Similar to flexure element 320, upper element 310, lower element 330 and/or common end 340 may be formed of a relatively lightweight, relatively stiff material. For example, upper element 310, lower element 330 and/or common end 340 may be formed of conventional midsole and/or outsole materials, such as natural or synthetic rubber or a combination thereof. The material may be solid, foamed, filled, etc. or a combination thereof. One particular material for use in upper element 310, lower element 330 and/or common end 340 may be Grilamid® LV-23H, a polyamide with a 23% glass fiber fill (supplied by EMS-GRIVORY). One particular rubber for use in upper element 310, lower element 330 and/or common end 340 may be an OGRS rubber. Another particular composite rubber mixture may include approximately 75% natural rubber and 25% synthetic rubber. The synthetic rubber could include a styrene-butadiene rubber.

By way of certain examples, other suitable polymeric materials for upper element 310, lower element 330 and/or common end 340 may include plastics, such as PEBAX® (a poly-ether-block co-polyamide polymer available from Atofina Corporation of Puteaux, France), silicone, thermoplastic polyurethane (TPU), polypropylene, polyethylene, ethylvinylacetate, and styrene ethylbutylene styrene, etc. Optionally, the material of upper element 310, lower element 330 and/or common end 340 may also include fillers or other components to tailor its hardness, wear, durability, coefficient of friction, abrasion-resistance, compressibility, stiffness and/or strength properties. Thus, for example, upper element 310, lower element 330 and/or common end 340 may include reinforcing fibers, such as carbon fibers, glass fibers, graphite fibers, aramid fibers, basalt fibers, etc. Optionally, the material of upper element 310, lower element 330, common end 340 and/or portions thereof could be provided as a foamed material, such as an injection molded foamed polymer.

According to certain aspects, flexure elements 320 may be unitarily and integrally molded (injection, compression, etc.) and/or co-molded with upper element 310, lower element 330, common end 340 and/or portions thereof. As one example, upper element 310 and certain flexure elements 320 projecting therefrom could be unitarily formed of injection molded foamed polymer. Advantageously, thicker portions of this unitarily formed sub-component, such as portions of the upper element 310, may be softer and more foam-like than thinner portions of this unitarily formed sub-component, such as portions of the flexure elements 320, which may be denser and stiffer.

As illustrated in FIGS. 1A-1B, support assembly structure 300 is positioned in the heel region 13 of the article of footwear 10. In this particular embodiment, support assembly structure 300 extends, at least partially, into midfoot region 12. According to even other aspects of this disclosure, a support assembly structure 300 may be provided in the forefoot region 11 of the article of footwear 10. In such an embodiment, it is expected that the overall height of the support assembly structure 300 provided in the forefoot region 11 would typically be less than that of a support assembly structure 300 provided in the heel region 13. By way of certain examples, the height (as measured from the lower surface of lower element 330 to the lower surface of upper element 310) of the support assembly structure 300 provided in the heel region 13 may range from approximately 10.0 mm to approximately 30.0 mm, from approximately 15.0 mm to approximately 30.0 mm or from approximately 20.0 mm to approximately 30.0 mm. For comparison purposes, the height of a support assembly structure 300 provided in the forefoot region 13 may range from approximately 5.0 mm to approximately 15.0 mm, from approximately 8.0 mm to approximately 15.0 mm or from approximately 10.0 mm to approximately 15.0 mm.

As illustrated in FIGS. 1A-1B, support assembly structure 300 is positioned on top of outsole structure 210. In this particular embodiment, outsole structure 210 extends as a single, continuous layer from the front edge 14 to the back edge 15 of the footwear 10. Lower element 330 may be secured to the upper surface of outsole structure 210 in any suitable, known fashion. The lower surface of outsole structure 210 may be provided with a suitable ground-engaging surface 215 such that a desired traction of outsole structure 210 (and thereby of the footwear 10) to the ground may be achieved. Further, support assembly structure 300 may be positioned below midsole structure 220. Upper element 310 may be secured to the lower surface of midsole structure 220 in any suitable, known fashion.

Thus, from the above disclosure it can be seen that the decoupled (or partially decoupled) vertical and lateral stiffness characteristics of sole structure 200 due to support assembly structure 300 provides better vertical impact protection, while still achieving the desired degree of stability (or, alternatively, flexibility) for a wearer of the article of footwear.

The performance characteristics of the support assembly structure 300 are primarily dependent upon factors that include the dimensional configurations of flexure elements 320, the number and placement of flexure elements 320, and the properties of the material selected for the flexure elements 320. By designing flexure element 320 to have specific dimensions and material properties, impact force attenuation and stability of the footwear 10 may be generally tuned to meet the specific demands of the activity for which the footwear is intended to be used. For walking shoes, for example, the dimensional and material properties of flexure element 320 may be selected to provide a medium degree of vertical impact force attenuation with a high degree of lateral stability. For running shoes, the impact-attenuating properties and the load carrying capacity of the flexure elements 320 may be enhanced, while still maintaining a relatively high degree of lateral stability. As another example, the dimensional and material configuration of the flexure elements 320 may be selected to provide an even greater degree of lateral stability in basketball shoes. Thus, it can be seen that the disclosed support assembly system allows the sole structure 200 to be tailored to the specific application. Additionally or alternatively, the support assembly system also may be selected and/or customized based on an individual user's physical characteristics (e.g., weight) and/or desired "feel" preferences. Even further, the support assembly structure 300 described above may be provided in conjunction with other impact-attenuation technologies. For example, there may also be provided in the article of footwear airbags, gel cushions, ramp airbags, etc. to aide in impact attenuation.

While the invention has been described with respect to specific examples including presently preferred modes of carrying out the invention, those skilled in the art, given the benefit of this disclosure, will appreciate that there are numerous variations and permutations of the above described structures, systems and techniques that fall within the spirit and scope of the invention as set forth above. Thus, for example, a wide variety of materials, having various properties, i.e., flexibility, hardness, durability, etc., may be used without departing from the invention. Finally, all examples, whether preceded by "for example," "such as," "including," or other itemizing terms, or followed by "etc.," are meant to be non-limiting examples, unless otherwise stated or obvious from the context of the specification.

We claim:

1. A sole structure for an article of footwear, comprising:

an upper element;

a lower element positioned below the upper element;

a first elongated, cantilevered flexure element extending from a base element, the base element constituting at least part of one of the upper element and the lower element; and a second elongated, cantilevered flexure element joined to an opposed element, the opposed element being at least a part of the other of the upper element and the lower element, the second flexure element extending from the opposed element toward the base element, wherein the first and second flexure elements have a first free end and a second free end respectively, and wherein the first flexure element is configured for slidingly contacting the opposed element when a vertical compressive load is applied to the upper element.

2. The sole structure of claim 1, wherein the first flexure element has a first elongated length and the second flexure element has a second elongated length, and wherein the first and second flexure elements overlap lengthwise along at least a portion of their respective lengths.

3. The sole structure of claim 1, wherein the second flexure element is laterally offset from the first flexure element.

4. The sole structure of claim 1, wherein the upper element includes an elongated track guiding element that includes two opposed sidewalls, and wherein the second free end of the second flexure element slides along the elongated track guiding element under the vertical compressive load and is constrained from sideways movement with respect to the elongated track guiding element by the two opposed sidewalls.

5. A sole structure for an article of footwear, comprising:

an upper element;

a lower element positioned below the upper element;

a first elongated, cantilevered flexure element extending from a base element, the base element constituting at least part of one of the upper element and the lower element; and a second elongated, cantilevered flexure element joined to an opposed element, the opposed element being at least a part of the other of the upper element and the lower element, the second flexure element extending from the opposed element toward the base element, wherein the first and second flexure elements have a first free end and a second free end respectively, and wherein the second flexure element is configured for slidingly contacting the base element when a vertical compressive load is applied to the upper element.

6. The sole structure of claim 5, wherein the first flexure element has a first elongated length and the second flexure element has a second elongated length, and wherein the first and second flexure elements overlap lengthwise along at least a portion of their respective lengths.

7. The sole structure of claim 5, wherein the second flexure element is laterally offset from the first flexure element.

8. The sole structure of claim 5, wherein the first flexure element extends in a first direction and the second flexure element extends in a second direction opposed to the first direction.

9. The sole structure of claim 5, wherein each of the first and second flexure elements extends in a longitudinal direction of the sole structure.

10. The sole structure of claim 5, wherein the upper element includes an elongated track guiding element that includes two opposed sidewalls, and wherein the second free end of the second flexure element slides along the elongated track guiding element under the vertical compressive load and is constrained from sideways movement with respect to the elongated track guiding element by the two opposed sidewalls.

11. A sole structure for an article of footwear, comprising:

an upper element including an upper base element;

a first elongated, cantilevered flexure element including a first base end attached to or integrally formed with the upper base element and a first free end opposite the first base end;

a lower element positioned below the upper element, wherein the lower element includes a lower base element; and a second elongated, cantilevered flexure element including a second base end attached to or integrally formed with the lower base element and a second free end opposite the second base end, wherein the first elongated, cantilevered flexure element extends toward the lower element and slidingly contacts a surface of the lower element when a vertical compressive load is applied to the upper element, and wherein the second elongated, cantilevered flexure element extends toward the upper element and slidingly contacts a surface of the upper element when the vertical compressive load is applied to the upper element.

12. The sole structure of claim 11, wherein the first elongated, cantilevered flexure element has a first elongated length and the second elongated, cantilevered flexure element has a second elongated length, and wherein the first elongated, cantilevered flexure element and the second elongated, cantilevered flexure element overlap lengthwise along at least a portion of their respective lengths.

13. The sole structure of claim 11, wherein the second elongated, cantilevered flexure element is laterally offset from the first elongated, cantilevered flexure element.

14. The sole structure of claim 11, wherein each of the first elongated, cantilevered flexure element and the second elongated, cantilevered flexure element extends in a longitudinal direction of the sole structure.

15. The sole structure of claim 11, wherein the upper element and the lower element are joined together at a common end.

16. The sole structure of claim 11, further comprising an outsole structure attached with the lower element.

17. The sole structure of claim 11, further comprising a polymer foam midsole structure attached with the upper element.

18. The sole structure of claim 11, wherein the first elongated, cantilevered flexure element has a convexly-curved portion facing the lower element, and wherein the second elongated, cantilevered flexure element has a convexly-curved portion facing the upper element.

19. The sole structure of claim 11, wherein the upper element includes a constraint element, and wherein the second free end of the second elongated, cantilevered flexure element slides within the constraint element under the vertical compressive load.

20. The sole structure of claim 11, wherein the upper element includes an elongated track guiding element that includes two opposed sidewalls, and wherein the second free end of the second elongated, cantilevered flexure element slides along the elongated track guiding element under the vertical compressive load and is constrained from sideways movement with respect to the elongated track guiding element by the two opposed sidewalls.

* * * * *